US005782536A

United States Patent [19]

Heidmann et al.

[11] Patent Number: 5,782,536

[45] Date of Patent: Jul. 21, 1998

[54] MODULAR CHAIR CONSTRUCTION AND METHOD OF ASSEMBLY

[75] Inventors: Kurt R. Heidmann, Grand Rapids; Brian L. Christensen, Wayland; Michael W. Haan, Byron Center; Glenn A. Knoblock, Kentwood; Eric T. McClure, Grand Rapids; Noe Palacios, Rockford; Brian H. Root, Grandville; David D. Sayers, Kentwood; Robert M. Scheper, Grand Rapids; Patrick P. Schwoerer, Sarrebourg; James P. Steffens, Hopkins; Greg A. VanStee, Grand Rapids, all of Mich.

[73] Assignee: Steelcase Inc., Grand Rapids, Mich.

[21] Appl. No.: 390,118

[22] Filed: Feb. 17, 1995

[51] Int. Cl.[6] ..... A47C 7/00

[52] U.S. Cl. ..... 297/440.15; 297/301.1; 297/302.2; 297/337

[58] Field of Search ..... 297/300.2, 300.5, 297/337, 440.15–440.22, 301.1, 301.4, 311, 440.14, 302.1, 302.4, 300.1, 440.1

[56] References Cited

U.S. PATENT DOCUMENTS

T103,201 7/1983 Robinson .
217,584 7/1879 Chichester .

(List continued on next page.)

FOREIGN PATENT DOCUMENTS 105955 10/1982 European Pat. Off. .

OTHER PUBLICATIONS

Exhibit A is a product catalog entitled "Northfield Furniture Components," dated Oct. 1991, published by EST Company, a division of Leggett & Platt, Inc. of Santa Fe Springs, California, disclosing various chair controls and chair components.

(List continued on next page.)

*Primary Examiner*—Milton Nelson, Jr.
*Attorney, Agent, or Firm*—Price, Heneveld, Cooper, DeWitt & Litton

[57] ABSTRACT

A chair construction and method for building a chair having selected features are provided. The construction includes a plurality of interchangeable different components including different base assemblies, back assemblies, seats, arms, and chair controls that can be selected to provide different features on a "customized" chair. The different chair controls are constructed from a selected one of a plurality of interchangeable energy modules and a selected one of a plurality of interchangeable seat support modules. All components include standardized connections for engaging the related components, and further include various mechanisms and designs so that by selecting particular components, a chair having various features and appearances can be provided. For example, the plurality of interchangeable seat support modules include a non-adjustable seat support module, a seat-angle-adjustable seat support module, and a seat-depth-adjustable seat support module. Also, the plurality of interchangeable chair control modules include a non-lockable energy module, a back lockable energy module, and a multi-position backstop energy module, each connectable to a selected one of the aforementioned seat support modules. The modularity of these components facilitates assembly including on-site assembly, repair, and post-assembly upgrading of the chair. Further, the seat support is connected by removable pivot pins to allow assembly, retrofit and/or modification in the field. The tension adjustment mechanism, the seat height actuator mechanism, and the pivot connections are constructed for durability, performance, assembleability, compactness of design, and to minimize the number of and complexity of parts. The method includes selecting modules from a menu of interconnectable/interchangeable modules to construct a chair control, and further selecting modules from a menu of interchangeable components to construct a chair having selected features.

19 Claims, 26 Drawing Sheets

U.S. PATENT DOCUMENTS

| | | | |
|---|---|---|---|
| D. 299,799 | 2/1989 | Muller-Deisig et al. . | |
| D. 309,383 | 7/1990 | Muller-Deisig et al. . | |
| D. 311,286 | 10/1990 | Muller-Deisig et al. . | |
| D. 312,003 | 11/1990 | Muller-Deisig et al. . | |
| D. 312,536 | 12/1990 | Muller-Deisig et al. . | |
| D. 318,184 | 7/1991 | Muller-Deisig et al. . | |
| 362,796 | 5/1887 | Tait . | |
| 446,080 | 2/1891 | Schrage . | |
| 569,809 | 10/1896 | Burke . | |
| 740,825 | 10/1903 | Dorney . | |
| 887,523 | 5/1908 | Ridlon . | |
| 947,380 | 1/1910 | Fischer et al. . | |
| 1,263,161 | 4/1918 | Travers . | |
| 1,302,212 | 4/1919 | Phillips . | |
| 1,570,436 | 1/1926 | Dawson . | |
| 1,699,894 | 1/1929 | Klemm . | |
| 1,719,435 | 7/1929 | Lowther . | |
| 2,221,268 | 11/1940 | Sears . | |
| 2,310,476 | 2/1943 | Todd . | |
| 2,471,024 | 5/1949 | Cramer | 297/300.5 |
| 2,869,392 | 1/1959 | Muller . | |
| 3,146,592 | 9/1964 | Johnson . | |
| 3,235,308 | 2/1966 | Conner . | |
| 3,339,973 | 9/1967 | Doerner . | |
| 3,539,142 | 11/1970 | Morand . | |
| 3,601,444 | 8/1971 | Doerner . | |
| 3,603,640 | 9/1971 | Doerner . | |
| 3,627,252 | 12/1971 | Yamaguchi . | |
| 3,675,887 | 7/1972 | Meinhardt . | |
| 3,709,535 | 1/1973 | Rothermel . | |
| 3,711,054 | 1/1973 | Bauer . | |
| 3,788,587 | 1/1974 | Stemmler . | |
| 3,790,119 | 2/1974 | Bauer . | |
| 3,853,297 | 12/1974 | Drolet . | |
| 3,880,465 | 4/1975 | Scheben . | |
| 3,913,975 | 10/1975 | Carter . | |
| 3,955,850 | 5/1976 | Toso . | |
| 3,982,785 | 9/1976 | Ambasz . | |
| 4,061,304 | 12/1977 | Schattmaier . | |
| 4,065,176 | 12/1977 | Fontana . | |
| 4,076,308 | 2/1978 | Slabon et al. . | |
| 4,099,775 | 7/1978 | Mizelle . | |
| 4,101,167 | 7/1978 | Ornberg . | |
| 4,161,305 | 7/1979 | Williams . | |
| 4,198,094 | 4/1980 | Bjerknes et al. . | |
| 4,214,726 | 7/1980 | Karrip et al. . | |
| 4,295,626 | 10/1981 | Large . | |
| 4,372,611 | 2/1983 | Feddeler . | |
| 4,373,692 | 2/1983 | Knoblauch et al. . | |
| 4,375,301 | 3/1983 | Pergler et al. . | |
| 4,390,206 | 6/1983 | Faiks et al. . | |
| 4,432,582 | 2/1984 | Wiesmann et al. . | |
| 4,438,898 | 3/1984 | Knoblauch et al. . | |
| 4,494,795 | 1/1985 | Roossien et al. . | |
| 4,537,445 | 8/1985 | Neuhoff . | |
| 4,561,693 | 12/1985 | Brownlie et al. . | |
| 4,570,895 | 2/1986 | Whitwam et al. . | |
| 4,626,029 | 12/1986 | Brauning . | |
| 4,640,488 | 2/1987 | Sakamoto . | |
| 4,640,548 | 2/1987 | Desanta . | |
| 4,653,806 | 3/1987 | Willi . | |
| 4,658,660 | 4/1987 | Parker . | |
| 4,682,814 | 7/1987 | Hansen . | |
| 4,709,963 | 12/1987 | Uecker et al. . | |
| 4,720,142 | 1/1988 | Holdredge et al. . | |
| 4,744,603 | 5/1988 | Knoblock . | |
| 4,763,951 | 8/1988 | Silverman | 297/440.15 |
| 4,776,633 | 10/1988 | Knoblock et al. . | |
| 4,781,353 | 11/1988 | Nishino . | |
| 4,790,600 | 12/1988 | Behringer . | |
| 4,817,760 | 4/1989 | Yamamura . | |
| 4,832,402 | 5/1989 | Zund . | |
| 4,892,354 | 1/1990 | Estkowski et al. . | |
| 4,906,045 | 3/1990 | Hofman . | |
| 4,911,501 | 3/1990 | Decker et al. . | |
| 4,966,412 | 10/1990 | Dauphin . | |
| 4,986,601 | 1/1991 | Inoue . | |
| 5,020,816 | 6/1991 | Mulholland . | |
| 5,029,940 | 7/1991 | Golynsky et al. . | |
| 5,035,466 | 7/1991 | Mathews et al. . | |
| 5,046,780 | 9/1991 | Decker et al. . | |
| 5,050,931 | 9/1991 | Knoblock . | |
| 5,106,157 | 4/1992 | Nagelkirk et al. . | |
| 5,108,149 | 4/1992 | Ambasz | 297/300.5 X |
| 5,114,211 | 5/1992 | Desanta . | |
| 5,150,948 | 9/1992 | Völkle . | |
| 5,192,114 | 3/1993 | Hollington et al. . | |
| 5,203,853 | 4/1993 | Caruso . | |
| 5,207,479 | 5/1993 | Wickman et al. . | |
| 5,213,295 | 5/1993 | Scholten et al. . | |
| 5,224,758 | 7/1993 | Takamatsu et al. . | |
| 5,238,294 | 8/1993 | Ishi et al. . | |
| 5,265,938 | 11/1993 | Melhuish et al. . | |
| 5,282,670 | 2/1994 | Karsten et al. . | |
| 5,288,138 | 2/1994 | Stulik et al. . | |
| 5,318,345 | 6/1994 | Olson . | |
| 5,328,242 | 7/1994 | Steffens et al. . | |
| 5,333,368 | 8/1994 | Kriener et al. . | |
| 5,348,371 | 9/1994 | Miotto . | |
| 5,370,445 | 12/1994 | Golynsky . | |
| 5,380,065 | 1/1995 | Rohrer . | |
| 5,382,077 | 1/1995 | Stumpf et al. . | |
| 5,385,388 | 1/1995 | Faiks et al. . | |

OTHER PUBLICATIONS

Exhibit B is a product brochure entitled "Relax Armrest," publication date unknown, published by RH Form AB, Bodafors, Sweden, dislosing an armrest.

Exhibit C is a product brochure entitled "The Chair Works," publication date unknown, published by The Chair Works, Inc., College Station, Texas, disclosing chairs having armrests.

Exhibit D is a product brochure entitled "Comforto®," publication date unknown, published by Haworth, Europe, disclosing various chairs with arms.

Exhibit E is a product brochure entitled "OfficeViews," publication date unknown, published by Sitag International, Irvine, California, disclosing various chairs with arms.

Exhibit F is a service assembly pictorial, published in 1993, by Steelcase Inc., assignee of the present invention, disclosing a method of partially disassembling a chair and adjusting a screw set in a chair height actuator lever to eliminate looseness in the lever.

Exhibit G is a drawing provided by Steelcase Inc., disclosing the prior art structure of the chair height actuator lever in Exhibit F. In "note 7," the drawing discloses a method of adjusting the pneumatic cylinder set screw to contact the spacer pin on the pneumatic cylinder during assembly to eliminate looseness in the lever.

Exhibit H is a drawing provided by Steelcase Inc., disclosing a prior art structure including a rubber torsion spring arrangement for a chair back support. The torsion spring arrangement includes a threaded adjustment member that threadably engages a torque arm on the torsion spring, the adjustment member including an end that abuts an upper chair structure.

Exhibit I are product brochures entitled "Synchro–tilt 5000 Series," publication date unknown, published by Northfield Metal Products Ltd., a division of Leggett & Platt, Waterloo, Ontario, Canada, disclosing synchrotilt controls. Page 4 discloses angular synchrotilt movements of a control.

Exhibit J are drawings of a prior art chair control assembly manufactured by Steelcase Inc., the non–modular chair control including an internally adjustable pivot arm and nut for a pneumatic chair height adjustment actuator, and a non–modular seat support/stretcher that is pivotally supported by a pivot axle on slide bearings.

Exhibit K is a catalog entitled "Sensible Seating," copyright 1993, published by Hon Company, Muscatine, Iowa, disclosing various chairs including, on the sixth page, a quick attach, adjustable arm moveable side–to–side and up–and–down.

Exhibit L is a product brochure entitled "Hon Group List Pricer," including a cover page and pp. 64, 90 and 98, published Jul. 10, 1994, published by Hon Company, Muscatine, Iowa, disclosing various chair movements and also disclosing a quick attach, adjustable arm moveable side–to–side and up–and–down.

Exhibit M includes ten photographs and two pages of sketches disclosing a known armrest construction manufactured by Hon Company, Muscatine, Iowa.

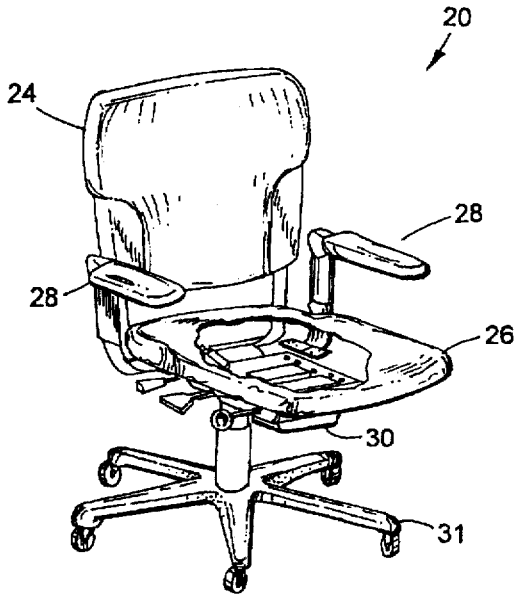
Fig. 1
Fig. 2
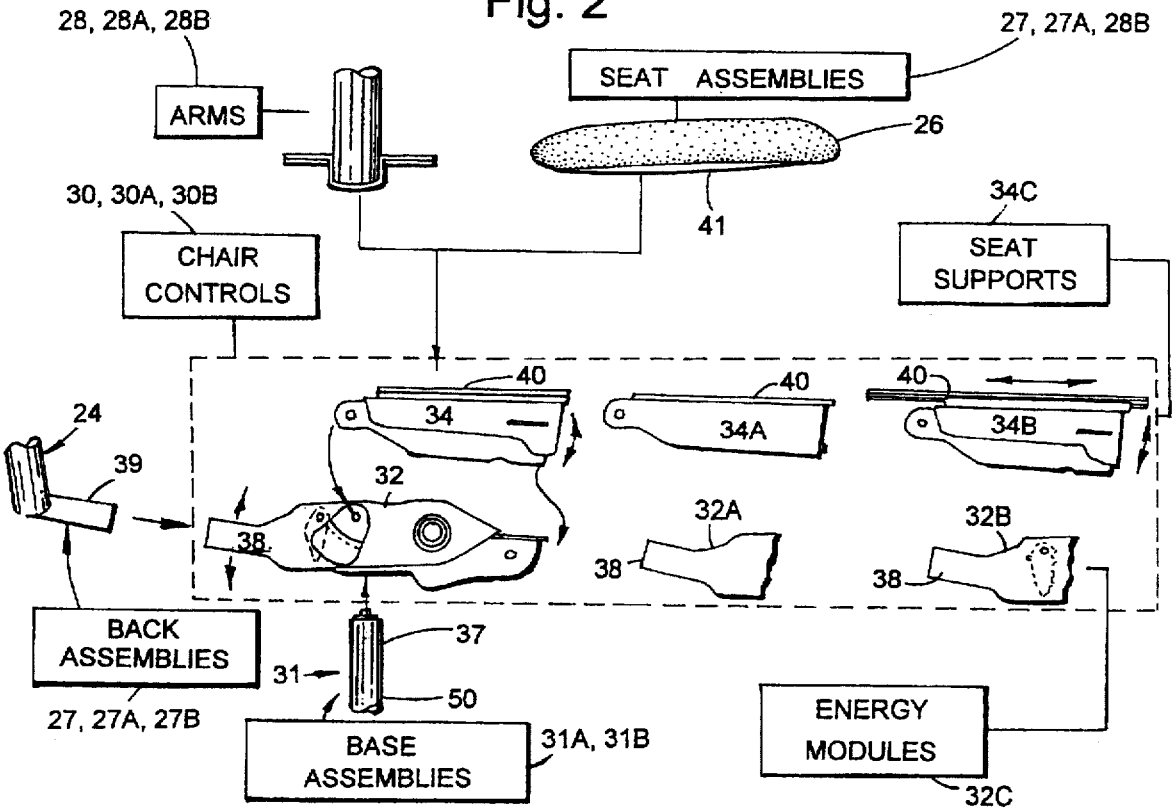

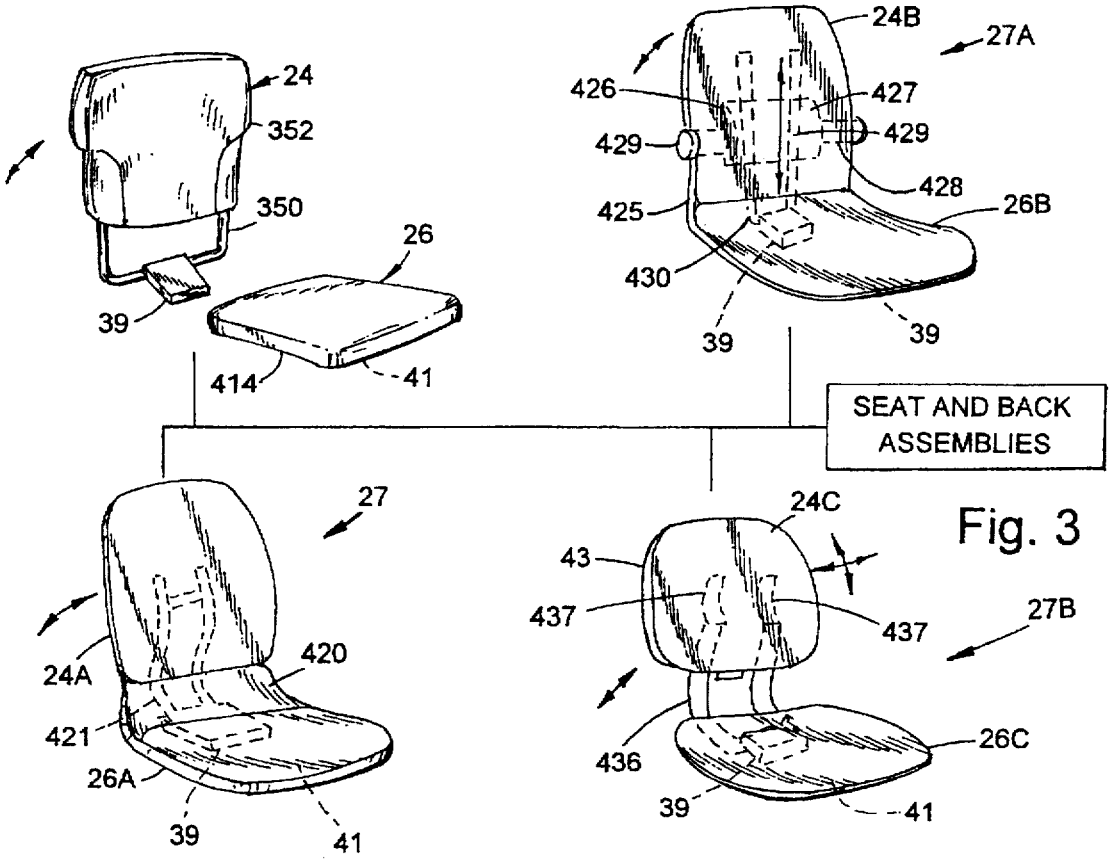
Fig. 3
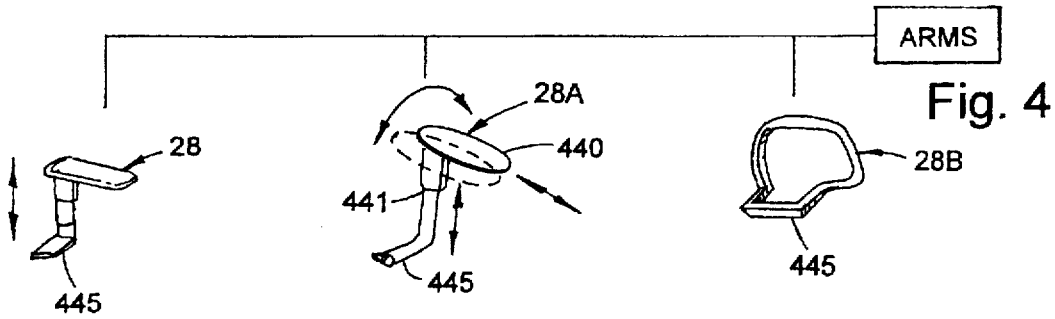
Fig. 4
Fig. 5
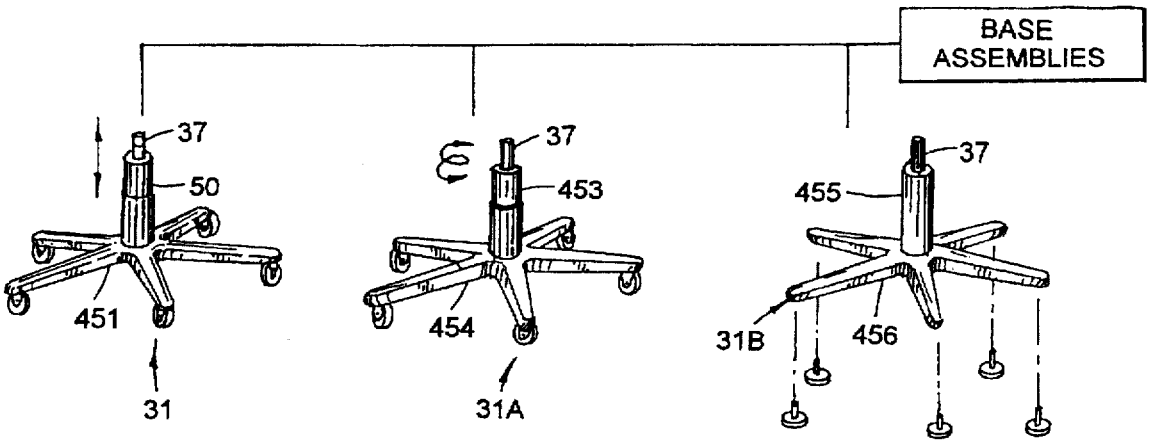

32
XXII
156
157
192
155
XXXIV
167
160
145
167
101
139
130
36
XIII
XIII
38
102
78
53
192
XXXIV
201
102
165
XXII 102
201
91
157
208
210
101
38
156
145
130
78
161
53
200
89
139
207
159
165
70
105
149
142
52
36

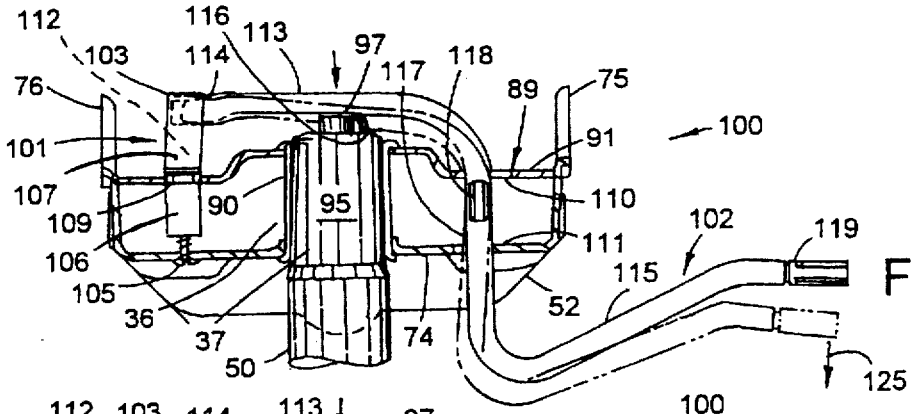
Fig. 22
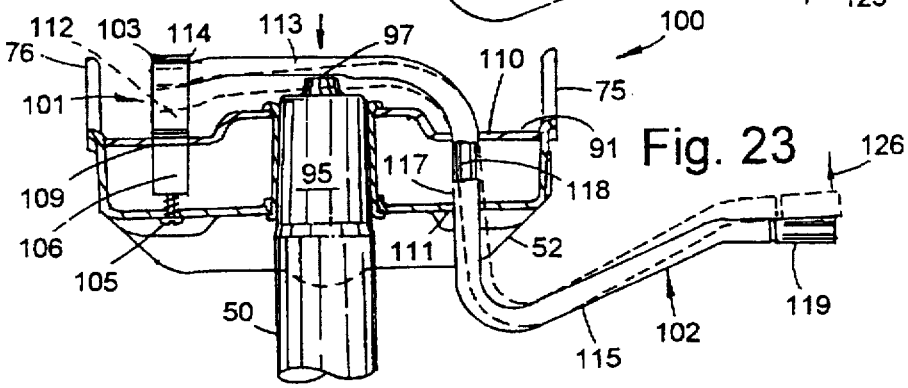
Fig. 23
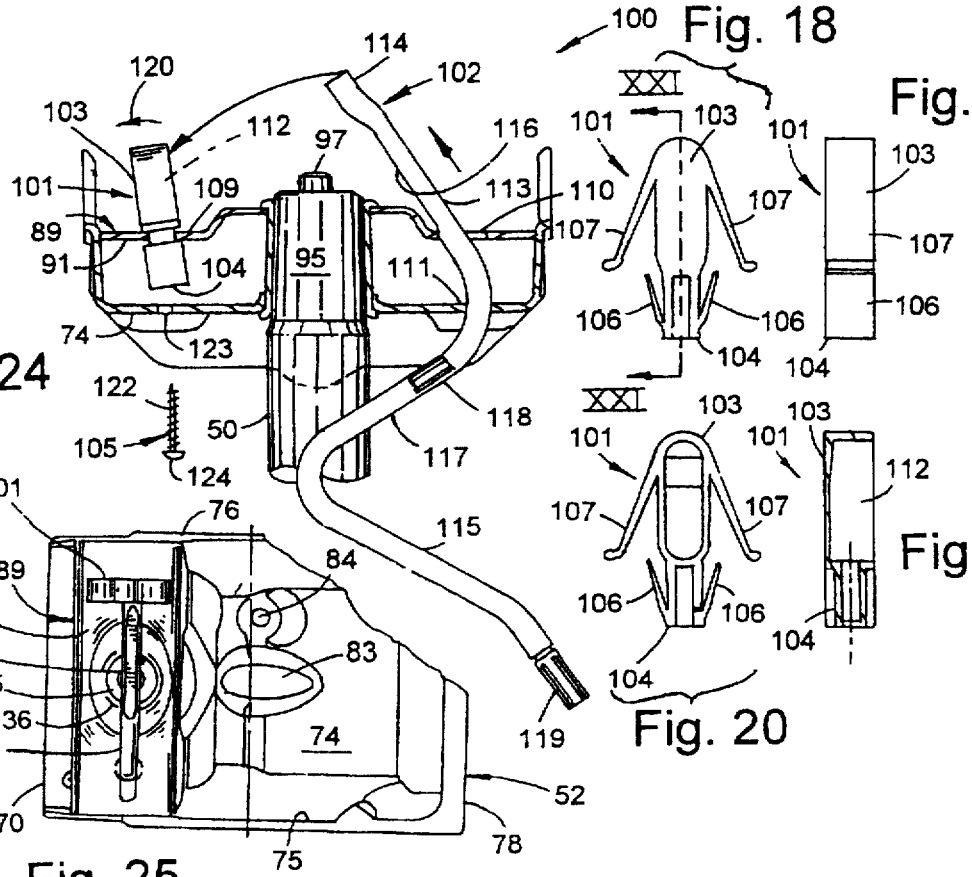
Fig. 18
Fig. 24
Fig. 25
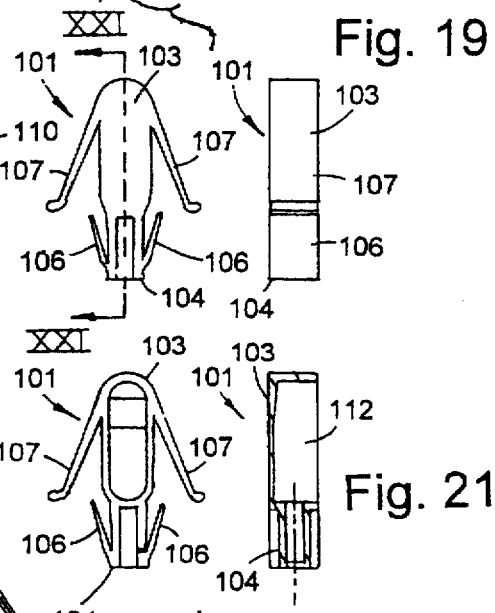
Fig. 19
Fig. 21
Fig. 20

Fig. 26
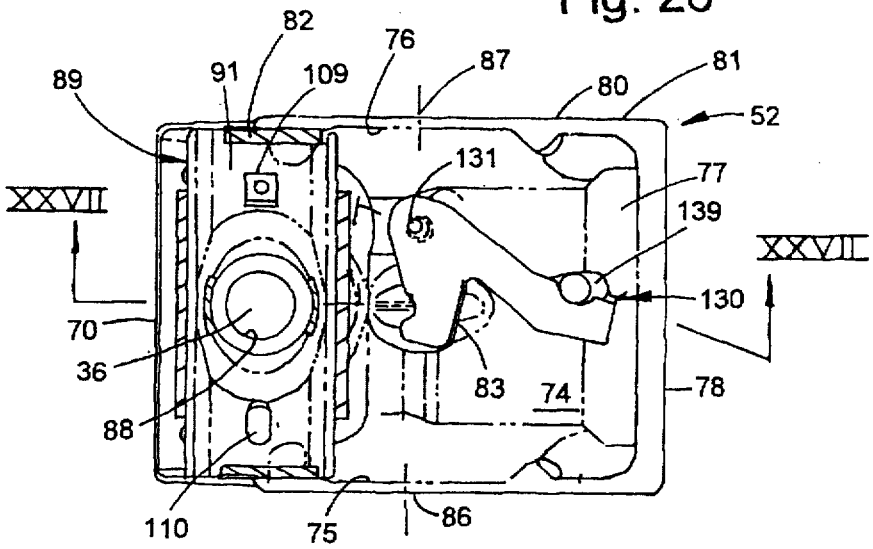
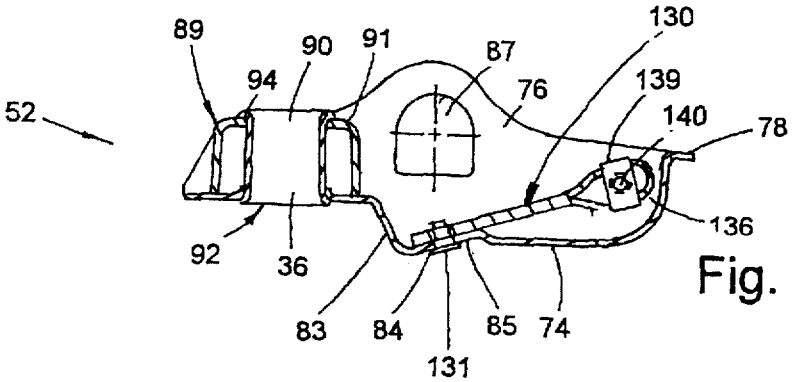
Fig. 27
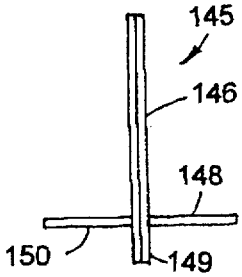
Fig. 28
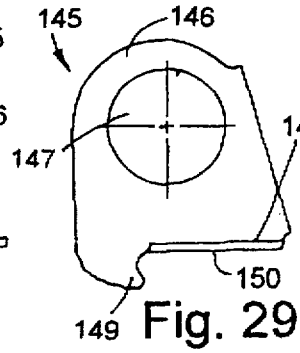
Fig. 29
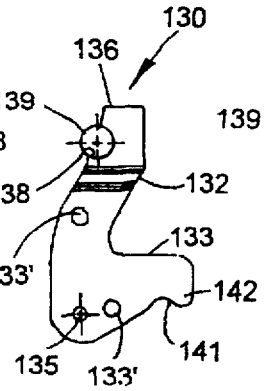
Fig. 31
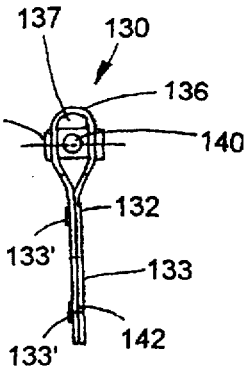
Fig. 32
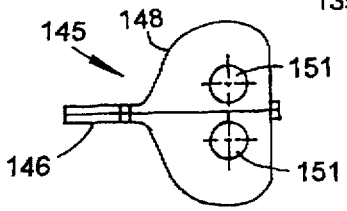
Fig. 30

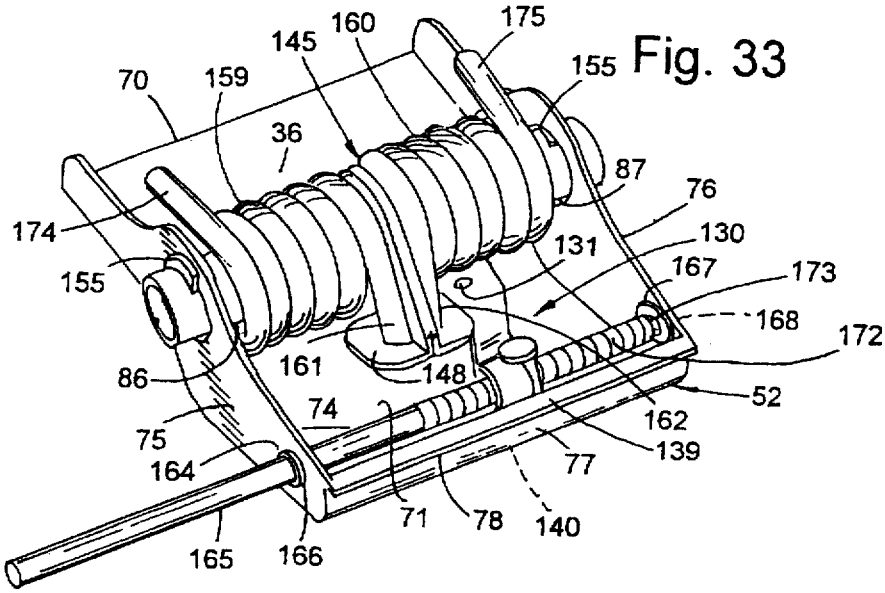
Fig. 33
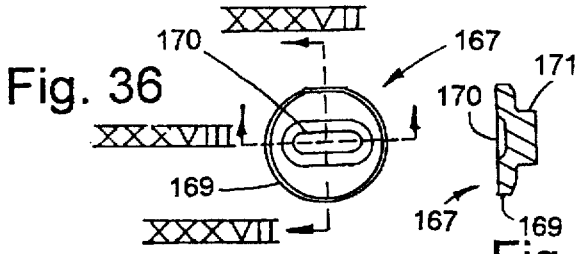
Fig. 36
Fig. 37
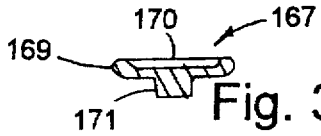
Fig. 38
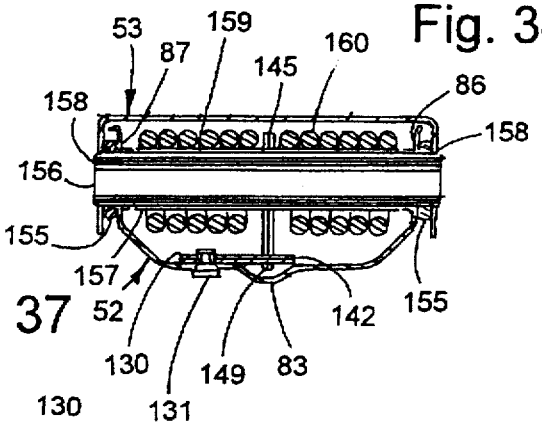
Fig. 34
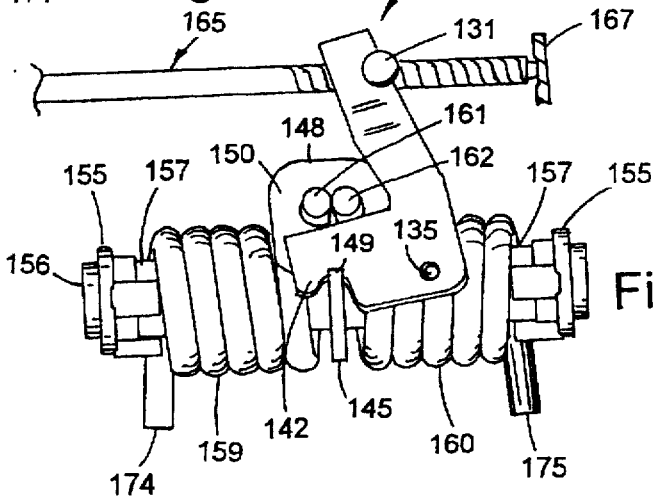
Fig. 35

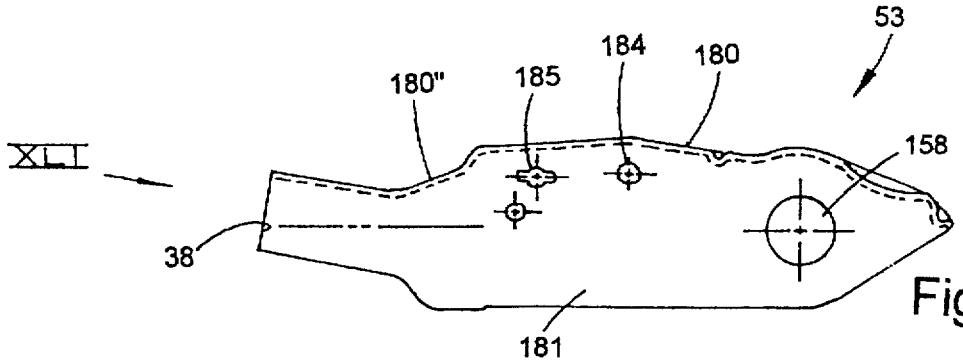
Fig. 39
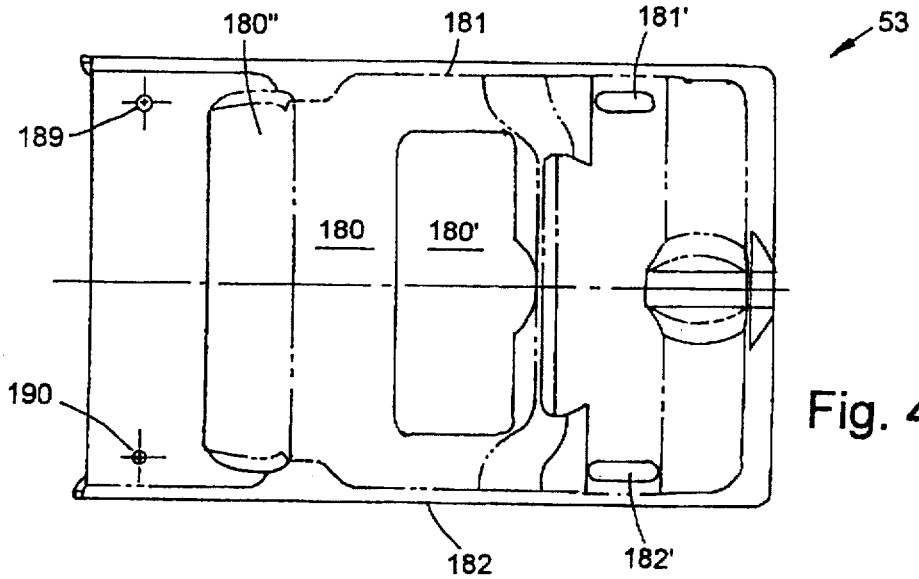
Fig. 40
Fig. 41
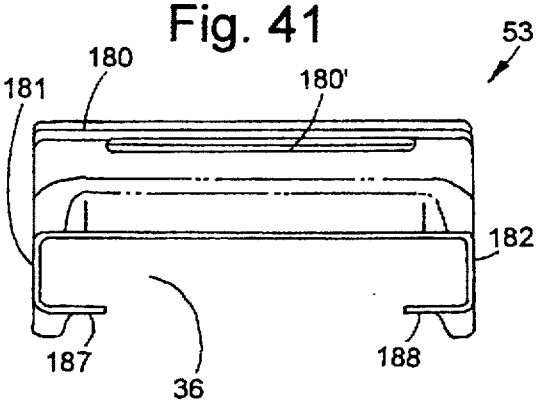
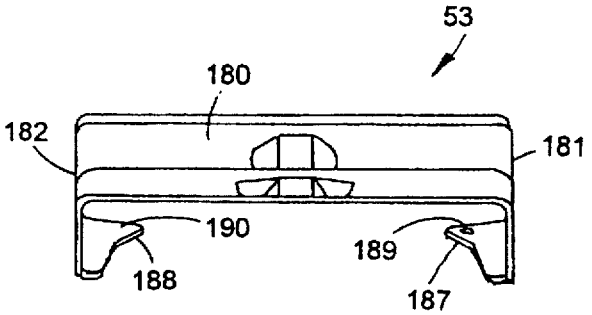
Fig. 42

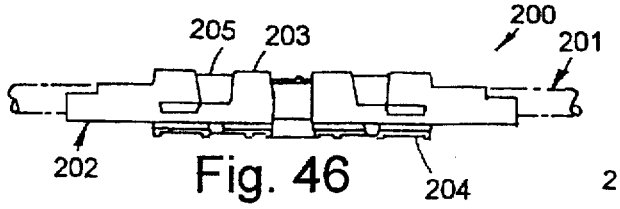
Fig. 46
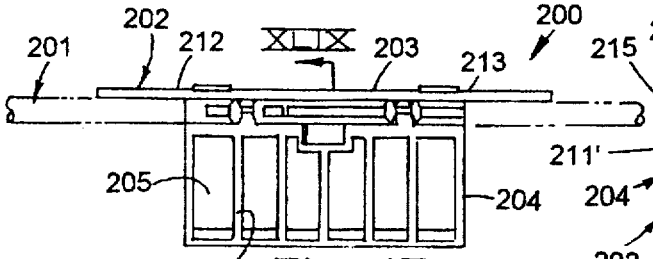
Fig. 47
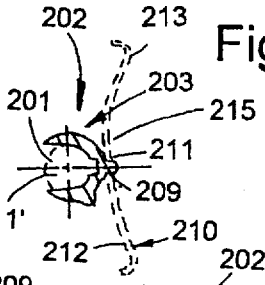
Fig. 49
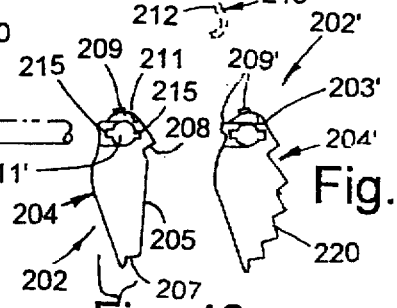
Fig. 52
Fig. 48
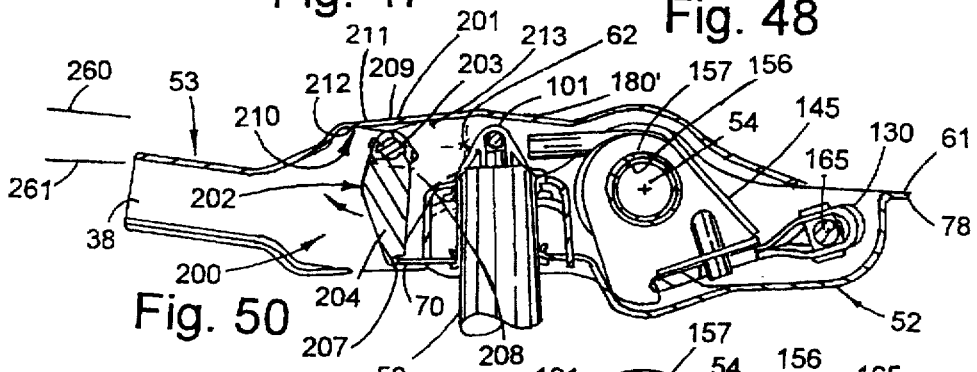
Fig. 50
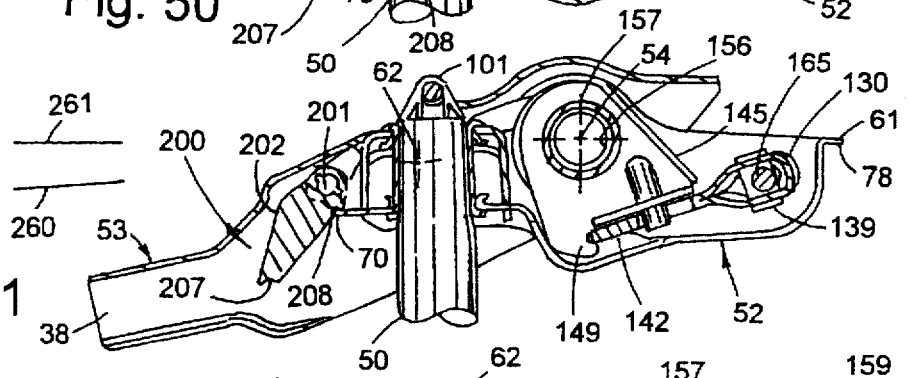
Fig. 51
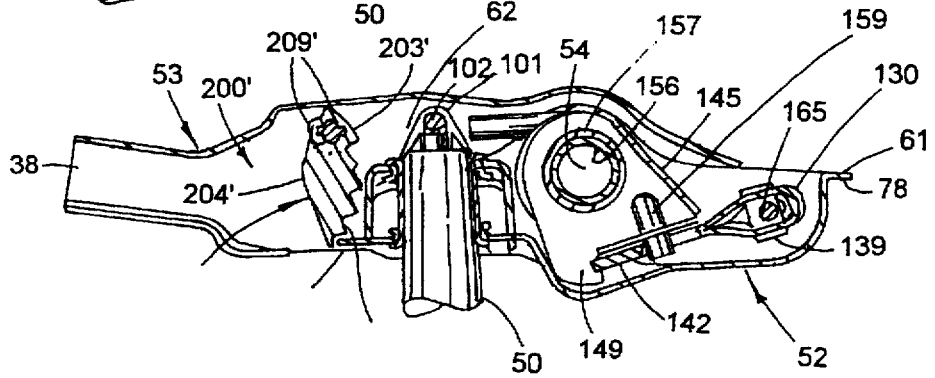
Fig. 53

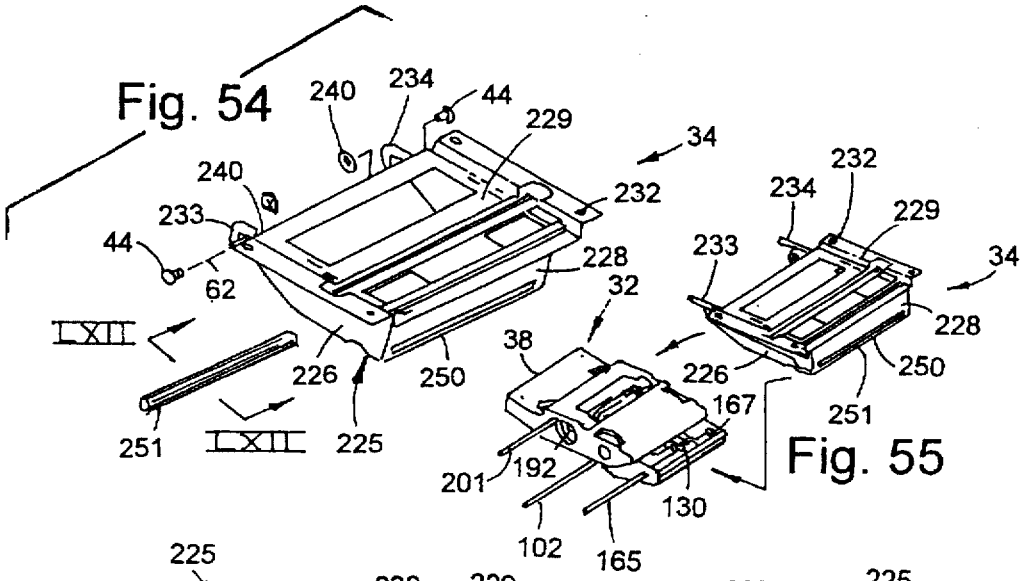
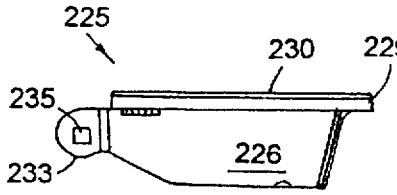
Fig. 56
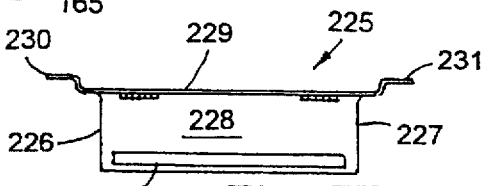
Fig. 57
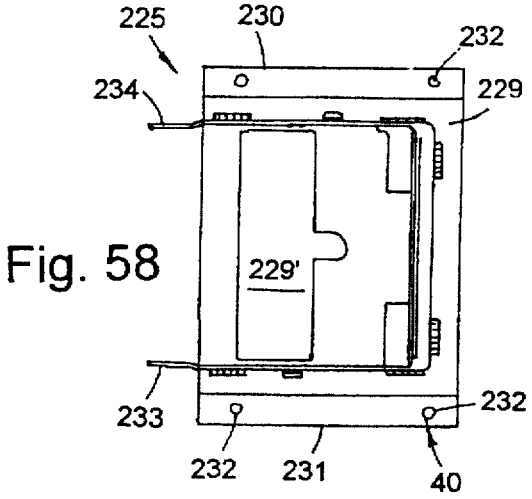
Fig. 58
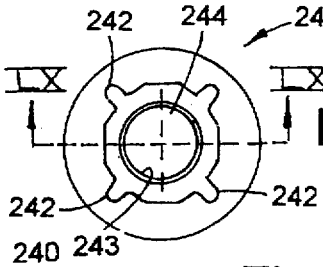
Fig. 59
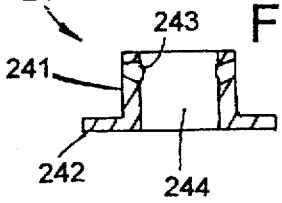
Fig. 60
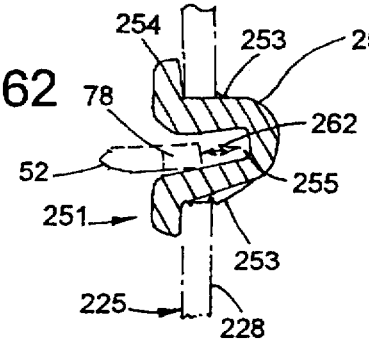
Fig. 62
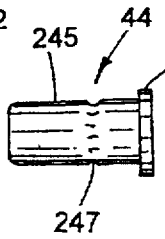
Fig. 61

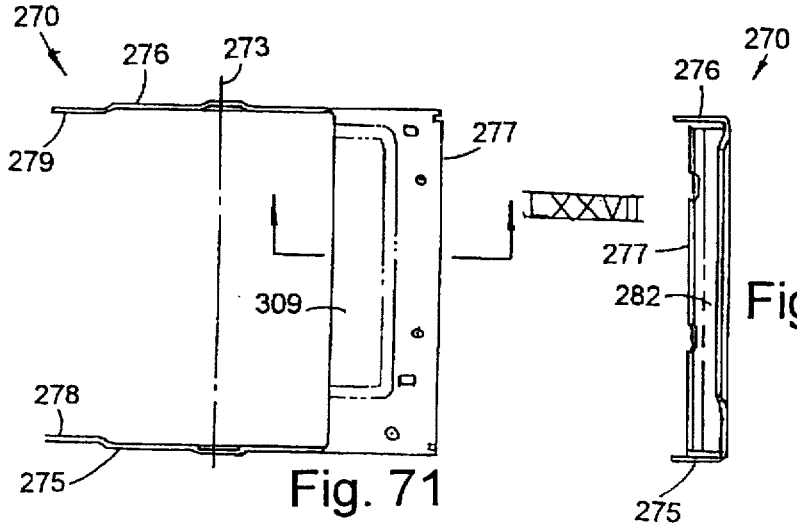
Fig. 71
Fig. 72
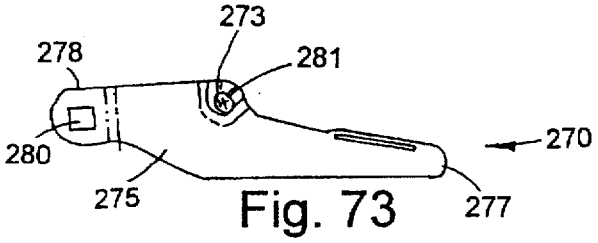
Fig. 73
Fig. 74
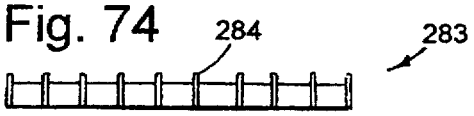
Fig. 75
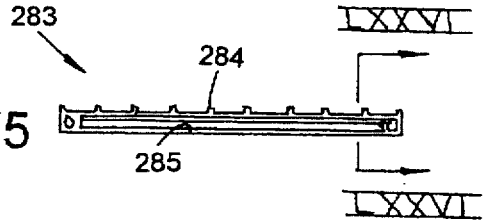
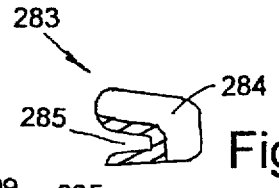
Fig. 76
Fig. 77
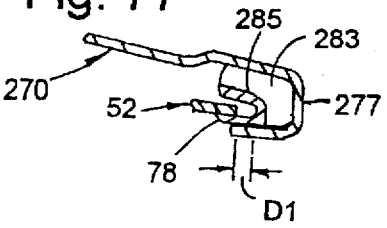
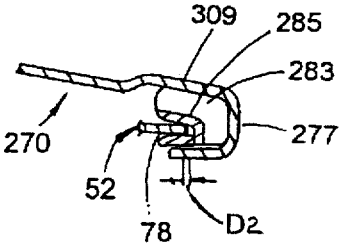
Fig. 78

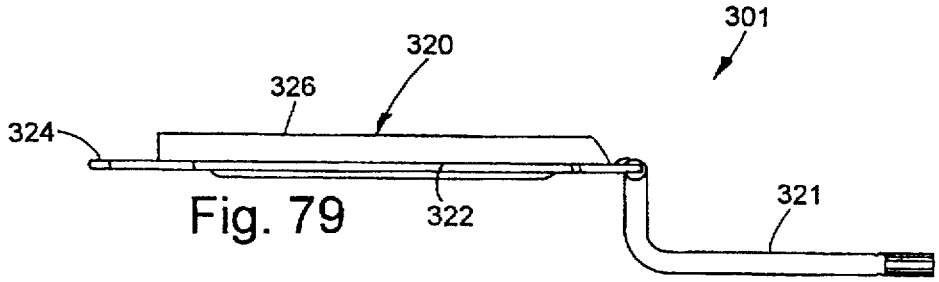
Fig. 79
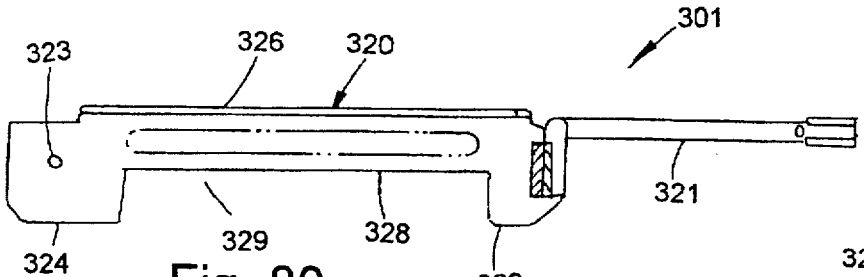
Fig. 80
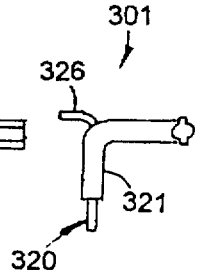
Fig. 81
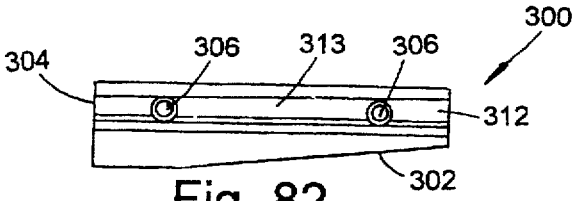
Fig. 82
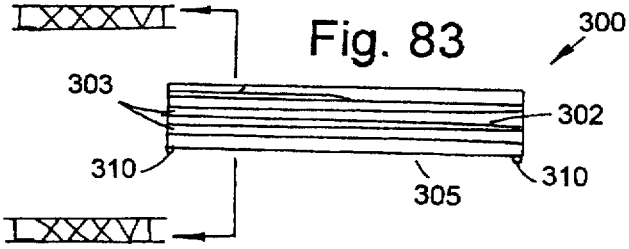
Fig. 83
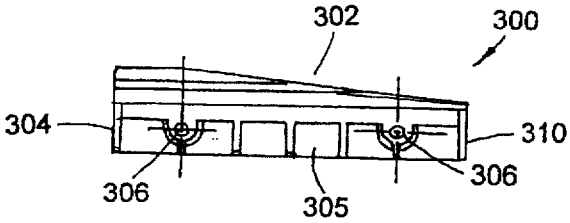
Fig. 85
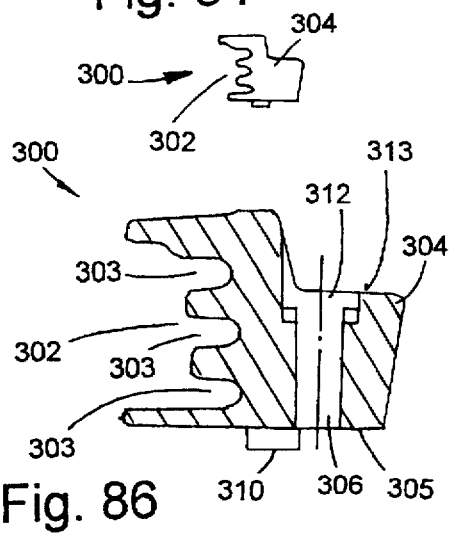
Fig. 84
Fig. 86

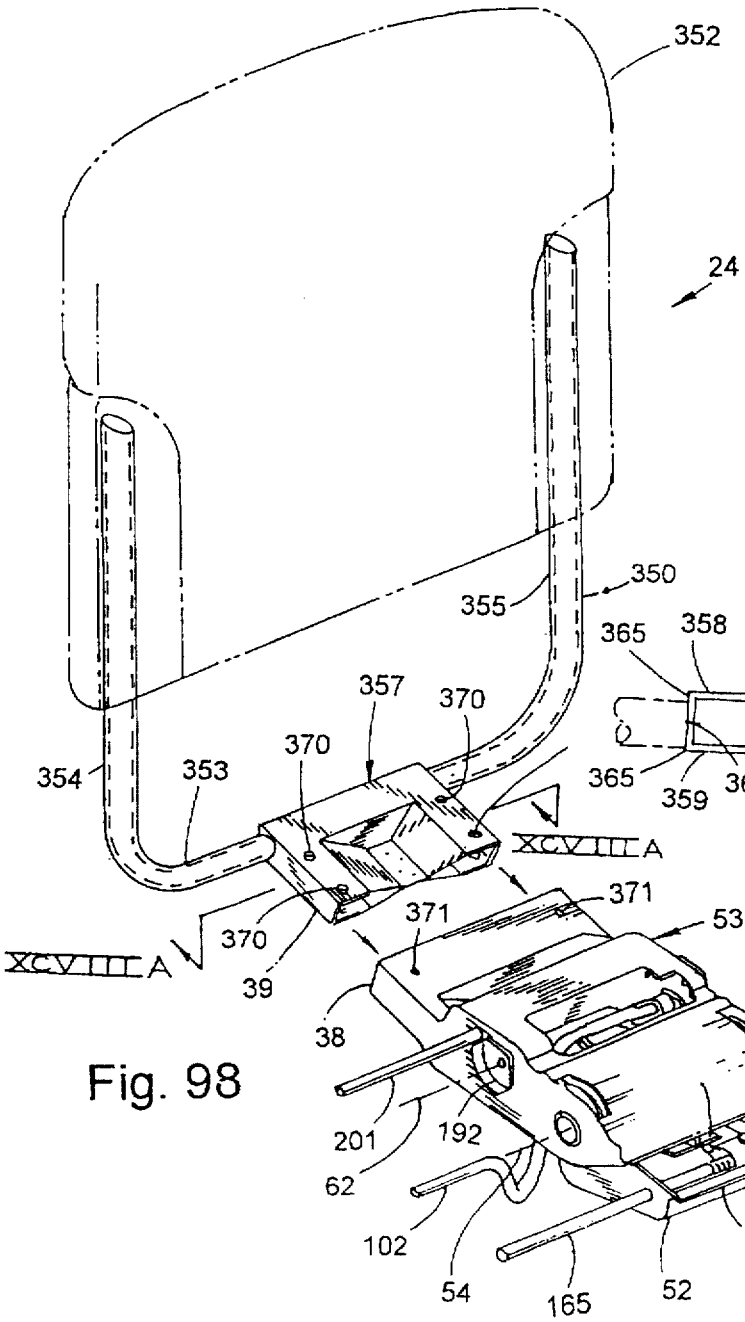
Fig. 98
Fig. 98A
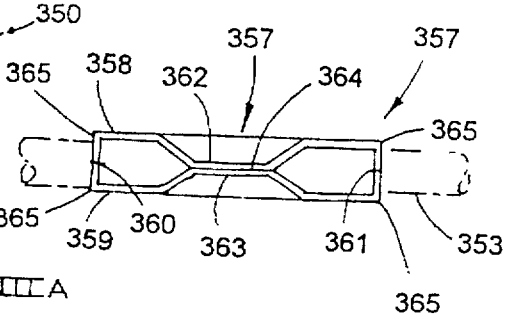

MODULAR CHAIR CONSTRUCTION AND METHOD OF ASSEMBLY

CROSS REFERENCE TO RELATED APPLICATIONS

This application is related to co-pending patent applications entitled "ARTICULATING ARMREST", Ser. No. 08/390,698, filed Feb. 17, 1995, in the name of inventors Arnold B. Dammermann et al.; "SEATING UNIT" (design), Ser. No. 29/035,048, filed Feb. 17, 1995, now U.S. Pat. No. D383,322 in the name of inventors Arnold B. Dammermann et al.; and "SEATING UNIT" (design), Ser. No. 29/035,345, filed Feb. 17, 1995, now U.S. Pat. No. D383,323 in the name of inventors Arnold B. Dammermann et al.; each of the co-pending applications being filed on even date herewith and each being assigned to the assignee of the present application, the entire contents of each co-pending application being incorporated by reference herein in its entirety.

BACKGROUND OF THE INVENTION

The present invention concerns a modular chair control construction and method incorporating selectable modular seat adjustment mechanisms that provide adjustability and adaptability to a person sitting in a chair incorporating the modular chair control construction. The present invention further concerns chairs that can be assembled from modular components, and more particularly concerns a modular chair construction and method having a movable seat and/or back, such as a synchrotilt chair, where components can be selected for assembly to construct a chair having selected features. Also, the present invention concerns a chair and related method to facilitate on-site assembly, repair, and post-assembly retrofit to allow addition of features to the chair not originally selected when the chair was assembled or purchased.

Synchrotilt chairs include a chair control configured to pivot a back and a seat at proportionally different angular rates of rotation, which are usually proportioned in a manner to reduce "shirt pull" as a person reclines or leans rearwardly in the chair. Known chair controls include a plurality of parts configured to accomplish the synchrotilt movement and to reduce shirt pull, but as a result, known synchrotilt chair controls tend to be relatively expensive and mechanically complex. Due at least in part to the number of parts and complexity, synchrotilt chair controls have typically been manufactured as permanently assembled units having specific features and/or adjustment mechanisms. This allows manufacturers to mass produce the chair controls with minimum assembly expense, and with a desired level of durability, integrity and reliability. However, this also means that if a chair having a different set of features is desired, a completely different chair control must be provided. This can result in substantial inventory carrying costs where chair controls are assembled ahead of schedule in anticipation of future orders. Alternatively, this can also result in long lead times if particular chair controls are assembled only when a sufficient number of orders have been received. Still further, completely different chair controls results in an undesirable proliferation of parts. It is sometimes possible to use an "up level" chair control having "extra" options in place of a lower level chair control in an effort to meet production ship schedules by leaving the "extra" options disconnected or inoperative. But this results in unnecessary expense in the form of wasted parts. Further, it is noted that if a part on the permanently assembled type chair control wears out or is found to be defective, the entire chair control must be thrown away since it is more expensive to repair the unit than simply provide another one.

In most synchrotilt chair controls, the seat is non-adjustably secured to the chair control. One known synchrotilt chair control disclosed in U.S. Pat. No. 5,328,242 (assigned to the present assignee) includes a mechanism for angularly adjusting a seat with respect to a base about an axle. However, the chair control in U.S. Pat. No. '242 is not modular, and further includes a plurality of parts making the chair control mechanically complex and difficult to repair in the field. Still further, the chair control in U.S. Pat. No. '242 is not adapted to allow addition of future modifications and/or adjustments to the seat which may be desired.

More broadly, chair improvements are desired to provide adjustability so that a person sitting in the chair can adjust the chair and/or adjust the chair control to their particular physical needs and preferences, and also can adjust the chair and/or chair control to satisfy the particular needs of a task being performed. Preferably, the adjustment mechanism should allow adjustment of the chair with a minimum of effort while sitting in the chair, so that the user does not need to repeatedly stand up to adjust the chair. Improvement is also desired to prevent looseness or play in actuating levers on the adjustment mechanism, and to allow on-site servicing of chairs, such as to remove or replace components. Additional improvement is further desired in chair control constructions so that multiple features can be provided in a compact package having a thin, sleek profile that is aesthetically pleasing and relatively easily incorporated into a chair, yet which is ready manufacturable and assembleable. Still further, present assemblies result in multiple loose or damaged pieces if disassembled for servicing, and further are not constructed for on-site disassembly and replacement of parts of upgrading.

Thus, a chair construction and method of assembly solving the aforementioned problems is desired. In particular, a chair construction including a modular chair control is desired that allows assembly of selected modular components having desired features but that is also sufficiently thin for aesthetics, that allows ready replacement of worn or damaged components, and that allows retrofitting/upgrading of the chair to incorporate additional features.

SUMMARY OF THE INVENTION

One aspect of the present invention is to provide a chair control construction and method capable of modular assembly to allow assembly of a chair control having selected features. The chair control construction includes an energy module having a fixed housing, a back upright support bracket rotatably connected to the fixed housing for movement between a fully upright position and a fully reclined position, and an energy source for biasing the back upright support bracket toward the fully upright position. The chair control construction further includes interchangeable seat support modules each configured for pivotal attachment to the fixed housing and the back upright support bracket at common connections points. The interchangeable seat support modules include a first seat support module having a non-adjustable seat support bracket configured to rotatably connect to the back upright support bracket. The interchangeable seat support modules further include a second seat support module having a synchrotilt bracket and an adjustable seat support bracket connected to the synchrotilt bracket, the adjustable seat support bracket being movably adjustably supported on the synchrotilt bracket for adjustment relative to the energy module. Thus, different style chair controls with different functions can be made from common parts.

In another aspect, an adjustable chair includes a base assembly, a back and an energy module rotatably connecting the back to the base assembly for rotation of the back about a back tilt axis between a fully upright position and a fully inclined position. The adjustable chair further includes a synchrotilt bracket rotatably connected to the energy module for rotation of the synchrotilt bracket about a seat tilt axis between a first position corresponding to the fully upright position and a second position corresponding to the fully reclined position. The adjustable chair still further includes an adjustable seat support operably connected to the synchrotilt bracket for rotation therewith, and a seat secured to the seat support.

In another aspect, a chair control and method includes providing a synchrotilt chair control including a fixed housing, a back upright support bracket rotationally connected to the fixed housing, a seat support, and removable/interference-fit pivot pins pivotally securing the seat support to the back upright support bracket. The method also includes removing the pivot pins, replacing the first seat support with a second seat support and reinstalling the pivot pins, whereby a synchrotilt chair control can be readily repaired or upgraded.

In another aspect, a chair control includes a fixed housing, a back support bracket rotatably secured to the fixed housing for movement about a back tilt axis between a fully upright position and a fully reclined position, and an energy source for biasing the back support bracket toward said fully upright position. A tension adjustment mechanism including a bell crank is pivotally attached to the fixed housing, the bell crank including a first leg having a threaded member thereon and a second leg operably engaging the energy source. The tension adjustment mechanism further includes a threaded rod engaging the threaded member and rotatably engaging the fixed housing so that the threaded rod can be rotated to move the threaded member along the rod in a selected axial direction to thus pivot the bell crank and in turn change the tension provided by the energy source.

In another aspect, a vertically adjustable chair includes a base assembly having a base and a vertically adjustable pedestal with a top actuator, a fixed housing engaging the pedestal, and a vertical adjustment control mechanism. The vertical adjustment control mechanism includes an arm pivotally mounted in the fixed housing, the arm including a bearing section for engaging the top actuator, a first section, and a handle-forming second section spaced from the first section. The vertical adjustment control further includes an adjustment member engaging the fixed housing and the first section for pivotally supporting the first section, the adjustment member being adjustable from an exterior of the fixed housing to reposition the first section and thus reposition the bearing section relative to the top actuator to eliminate looseness and play of the arm in the fixed housing. The arm operably engages at least one of the fixed housing and the adjustment member so that when the handle-forming second section is pivoted, the bearing section actuates the top actuator.

In another aspect, a synchrotilt chair control includes a fixed housing, a back upright support bracket rotatably connected to the fixed housing for movement about a back tilt axis between a fully upright position and a fully reclined position, and a seat support module. The seat support module includes a synchrotilt bracket rotatably connected to the fixed housing for movement about a seat tilt axis spaced from the back tilt axis. The synchrotilt bracket is rotatably connected to the back upright support bracket and defines a common tilt axis, one of the back tilt axis, the seat tilt axis, and the common axis moving translationally as the back upright support bracket is moved between the fully upright position and the fully reclined position. The axes are further positioned so that the common tilt axis passes through a line connecting the back tilt axis and the seat tilt axis as the back upright support bracket is pivoted between the fully upright position and the fully reclined position such that the translational movement of the one axis is minimized.

These and other features, advantages and objects of the present invention will be further understood and appreciated by those skilled in the art by reference to the following specification, claims and appended drawings.

BRIEF DESCRIPTION OF THE DRAWINGS

FIG. 1 is a perspective view of a chair embodying the present invention, the chair being constructed of modular components attached to a modular chair control and the seat being partially broken away to show the chair control;

FIG. 2 is a schematic view of a chair construction embodying the present invention, the chair construction including a chair control constructed from selected energy modules and selected seat support modules, and further including a plurality of modules attachable to the chair control;

FIG. 3 is a schematic view of a menu of various seat and back assemblies, each of which are shown separately in perspective, configured for attachment to the chair controls shown in FIG. 2;

FIG. 4 is a schematic view of a menu of various arms, each of which are shown separately in perspective, configured for attachment to the seat or the chair control shown in FIG. 2;

FIG. 5 is a schematic view of a menu of base assemblies, each of which are shown separately in perspective, configured for attachment to the chair control shown in FIG. 2;

FIGS. 18–20 are enlarged side, front and opposite side views of the height-actuator-rod adjustment member shown in FIG. 9;

FIG. 21 is a cross-sectional view of the adjustment member taken along plane XXI—XXI in FIG. 18;

FIG. 22 is a cross-sectional view of the fixed housing and actuator control mechanism taken along the plane XXII—XXII in FIG. 12, the view also including the top portion of a vertically adjustable pedestal, the actuator arm of the actuator control mechanism being shown in solid lines in a non-actuated position and in phantom lines in a lowered actuating position;

FIG. 23 is a cross-sectional view comparable to FIG. 22, the actuator arm being shown in solid lines and a non-actuated position and in phantom lines in a raised actuating position;

FIG. 24 is a cross-sectional view comparable to FIG. 22 but showing installation of the actuator arm into the fixed housing;

FIG. 25 is a fragmentary plan view of the fixed housing and the actuator control mechanism shown in FIG. 22;

FIG. 26 is a plan view of the fixed housing and the bell crank shown in FIG. 9, the bell crank being pivotally attached to the fixed housing;

FIG. 27 is a cross-sectional view taken along the plane XXVII—XXVII in FIG. 26;

FIGS. 28–30 are orthogonal views of the spring-engaging tension adjust bracket shown in FIG. 9;

FIGS. 31–32 are plan and side views of the bell crank shown in FIG. 26;

FIG. 33 is a top perspective view of the energy module shown in FIG. 8, including the spring tension adjustment mechanism and the torsion spring assembly but with the back upright support bracket removed to expose the aforementioned parts;

FIG. 34 is a cross-sectional view taken along the plane XXXIV—XXXIV in FIG. 12;

FIG. 35 is a bottom view of the spring tension adjustment mechanism shown in FIG. 33, the fixed housing being removed to facilitate showing the relationship of the parts;

FIG. 36 is a plan view of the tension rod pivot/slide bearing shown in FIG. 33;

FIGS. 37–38 are cross-sectional views taken along the planes XXXVII—XXXVII and XXXVIII—XXXVIII, respectively, in FIG. 36;

FIG. 39 is a side view of the back upright support bracket shown in FIG. 9;

FIG. 40 is a top plan view of the back upright support bracket shown in FIG. 39;

FIG. 41 is a rear elevational view taken in the direction of arrow XLI in FIG. 39;

FIG. 42 is a front elevational view of the back upright support bracket shown in FIG. 39;

FIGS. 46–47 are top and front views of the back lock mechanism;

FIG. 48 is a side view of the locking element of the back locking member shown in FIG. 47;

FIG. 49 is a cross-sectional view taken along the lines XLIX—XLIX in FIG. 47;

FIG. 50 is a cross-sectional view taken along the plane L—L in FIG. 10, the energy module being shown in the fully upright position;

FIG. 51 is a cross-sectional view comparable to FIG. 50, but with the energy module being shown in the fully reclined position;

FIG. 52 is an alternative embodiment of the locking element shown in FIG. 49, the modified locking element including a multi-stepped face;

FIG. 53 is a side cross-sectional view of a modified energy module incorporating the modified locking element shown in FIG. 52;

FIG. 54 is an exploded perspective view of a non-adjustable seat support module shown in FIG. 2;

FIG. 55 is a perspective view showing assembly of the non-adjustable seat support module shown in FIG. 54 to an energy module shown in FIG. 8;

FIGS. 56–58 are orthogonal views of the non-adjustable seat support bracket shown in FIG. 54;

FIG. 59 is a side view of the synchrotilt pivot bushing shown in FIG. 54;

FIG. 60 is a cross-sectional view taken along the plane LX—LX in FIG. 59;

FIG. 61 is a side view of the removable synchrotilt pivot pin shown in FIG. 54;

FIG. 62 is an enlarged cross-sectional view of the elongated synchrotilt bushing taken along the plane LXII—LXII in FIG. 54;

FIGS. 71–73 are orthogonal views of the synchrotilt bracket shown in FIG. 70;

FIGS. 74–75 are top and rear views of the front bushing shown in FIG. 70;

FIG. 76 is a cross-sectional view taken along the plane LXXVI—LXXVI in FIG. 75;

FIGS. 77–78 are cross-sectional views taken along the plane LXXVII—LXXVII in FIG. 71, with the addition of the front bushing shown in FIG. 76 and the front flange on the fixed housing, FIG. 77 showing the relative position of the front flange when the back upright support bracket is in the fully upright position or in the fully reclined position, FIG. 78 showing the relative position of the front flange when the back upright support bracket is in a mid position halfway between the fully upright position and the fully reclined position;

FIGS. 79–81 are orthogonal views of the seat-angle-adjustment lever shown in FIG. 70;

FIGS. 82–84 are orthogonal views of the stop block of the seat-angle-adjustment mechanism shown in FIG. 70;

FIG. 85 is a bottom view of the stop block shown in FIGS. 82–84;

FIG. 86 is an enlarged cross-sectional view taken along the plane LXXXVI—LXXXVI in FIG. 85;

FIG. 98 is a perspective view showing attachment of a back upright to a control module;

FIG. 98A is a cross-sectional view taken along the plane XCVIIIA—XCVIIIA in FIG. 98;

DETAILED DESCRIPTION OF PREFERRED EMBODIMENT

Figure 7:
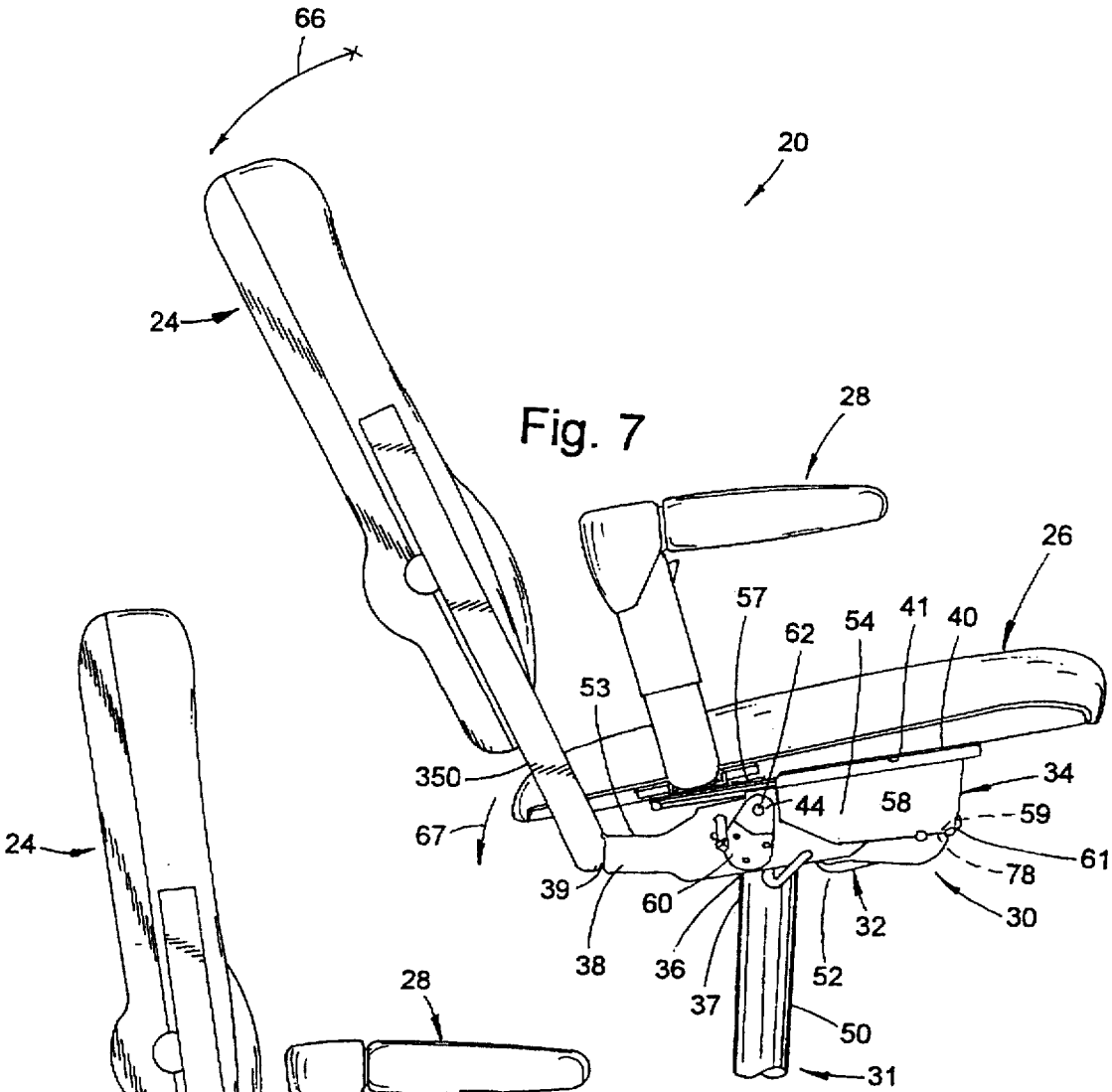
FIG. 7 is a fragmentary side view of the chair shown in FIG. 5, the back being in a fully reclined position.

For purposes of description herein, the terms "upper," "lower," "right," "left," "rear," "front," "vertical," "horizontal" and derivatives thereof shall relate to the invention as oriented in FIG. 1, the front being located generally to the right and at the knees of a person sitting in the chair. However, it is to be understood that the invention may assume various alternative orientations, except where expressly specified to the contrary. It is also to be understood that the specific devices and processes illustrated in the attached drawings and described in the following specification as simply exemplary embodiments of the inventive concepts defined in the appended claims. Hence, specific dimensions and other physical characteristics relating to the embodiments disclosed herein are not to be considered as limiting, unless the claims expressly state otherwise.

A chair 20 (FIG. 1) having selected features is constructed from a chair construction kit 22 (FIG. 2). The chair construction kit 22 includes a plurality of possible chair controls 30, 30A and 30B that are assembled from a menu of modules, including energy modules 32, 32A, 32B and 32C and seat support modules 34, 34A and 34B. In the illustrated chair controls, chair control 30 includes a back-lockable synchrotilt energy module 32 and a non-adjustable seat support module 34, chair control 30A includes a non-lockable, synchrotilt energy module 32A and a seat-angle-adjustable seat support 34A, and chair control 30B includes a multi-position backstop energy module 32B and a seat-depth-adjustable and seat-angle-adjustable seat support module 34B. However, it is noted that each of energy modules 32, 32A and 32B can be assembled to each of seat support modules 34, 34A and 34B. Further, it is contemplated that other energy modules 32C and seat support modules 34C having other features will be developed in the future. Optimally, the seat supports are connected to the energy modules with externally removable pivot pins 44, such that the control modules can be assembled and/or disassembled on-site and/or retrofit, repaired, or modified in the field. The modularity lends itself to development of additional modules, such as additional seat support modules and additional energy modules, to provide additional or different features, or combinations of selected features. Thus, the present disclosure is not intended to be unnecessarily limiting. Further, it is noted that the module units that can be handled, stored and shipped without fear of lost small parts and with the knowledge that only limited labor is required in the field for assembly since the parts are substantially preassembled as modular units.

The construction kit 22 further includes a plurality of selectable modules attachable to chair controls 30, 30A and 30B including back assembly 24, seat assembly 26, back and seat assemblies 27, 27A and 27B (FIG. 3) and base assemblies 31, 31A and 31B (FIG. 5). Arms 28, 28A and 28B (FIG. 4) are selectively attachable to seat assemblies 26, 27, 27A or 27B. Each chair control (FIG. 2) includes standardized interface points or connectors 36, 38 and 40 for engaging mating connectors 37, 39 and 41 on the related components, and further includes various adjustment mechanisms so that by selecting particular components, a chair having various selected "customized" features can be provided. The standardized connectors and plurality of interconnectable components, like the modular chair controls, lend themselves to development of additional components in the future.

In the chair construction kit 22, the modularity has been extended beyond a mere commonality of several parts during initial construction. In kit 22, there is a correspondence between separate modules and their specific functions or groups of functions. Each module is a separate, stand alone, self-contained, self-functioning unit. Connections between modules are at standardized interface points. Activators, including levers, rotatable rods, handles, cable actuators and the like, for activating the function(s) on a given module can be attached to and are part of the respective module. The modules are unitary, and do not fall apart into multiple pieces when removed. Additionally, the modules are relatively easily installed, are installed with few pieces and with few tools, and are installed with parts that are re-useable, such as re-useable pivot pins 44. Assembleability is enhanced since the front connection on the energy modules is made by sliding the seat support module onto the front flange 78 of the energy module, and the rear connection is made by pressing pivot pins 44 into holes that are easily seen and aligned. The modules also allow conversation of available space by tailoring individual modules to incorporate only desired functions and features.

Figure 6:
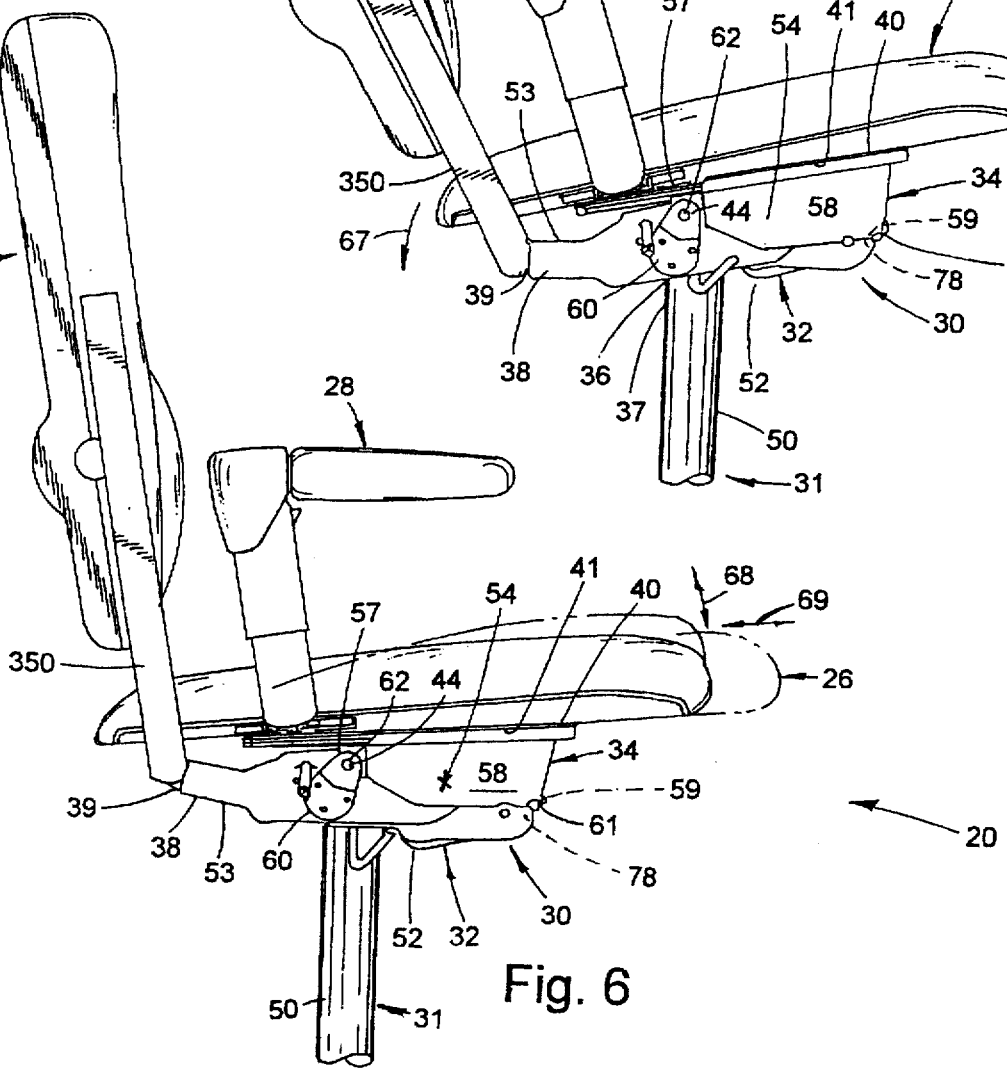
FIG. 6 is a fragmentary side view of the chair shown in FIG. 1, the back being in a fully upright position.
Figure 8:
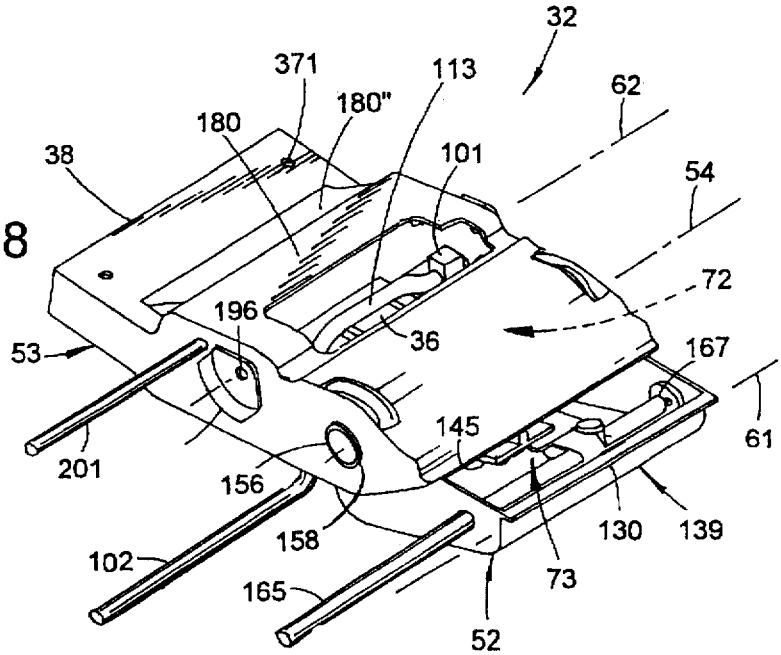
FIG. 8 is a perspective view of a first energy module shown in FIG. 2.

The particular chair 20 shown in FIGS. 6–7 includes the back assembly 24, the seat assembly 26, the arm 28, the synchrotilt chair control 30 (including the energy module 32 and the seat support 34), and the base assembly 31, each configured to mateably engage each other for assembly. More particularly, the base assembly 31 includes a pedestal 50 with a tapered surface defining standardized male connector 37. The energy module 32 includes a fixed housing 52, and a back upright support bracket 53 pivotally mounted thereon for moving back assembly 24 pivotally about a back tilt axis 54. Fixed housing 52 includes a tapered surface defining standardized female connector 36 for mateably receiving male connector 37 on pedestal 50. Back upright support bracket 53 further includes a rearwardly facing rectangular throat defining the female connector 38, and back assembly 24 includes a back upright 350 having a box-shaped end defining the male connector 39 for engaging female connector 38. Fixed housing 52 includes a front flange or nose flange 78, and back upright support bracket 53 includes a pair of ear flanges 57 spaced rearwardly from front flange 78. Flanges 78 and 57 define a connector arrangement for engaging the seat support 34. Seat support 34 includes a seat-engaging bracket 58 with a rearwardly facing pocket 59 at its front end for slidably and rotatably engaging nose flange 78, and tail flanges 60 pivotally connected to ear flanges 57 by removable pivot pins 44. The pocket 59 and tail flanges 60 on seat support 34 define a standardized connector arrangement for engaging the energy module 32 (i.e. flanges 78 and 57). Nose flange 78 defines a seat tilt axis 61, and ear flanges 57 define a common axis 62 at pivot pins 44. Seat support 34 includes a rectangular generally planar pattern of apertured flanges defining connector 40, and seat assembly 26 includes a mating pattern of holes defining connector 41 for receiving screws to secure seat assembly 26 to seat support 34.

The chair 20 provides a synchrotilt ride as follows. As a person tilts rearwardly in chair 22 (FIG. 7), back assembly 24 pivots rearwardly about back tilt axis 54 at a first angular rate of rotation along arrow 66. Seat 26 simultaneously rotates about seat tilt axis 61 along arrow 67. Preferably, seat assembly 26 rotates at about half the angular rate of rotation of back assembly 24, although it is noted that various ratios can be achieved by varying the distance between axes 54, 61 and 62, such as by providing various chair control module constructions. Due to the interconnection of assemblies 24, 26 and 30, both back assembly 24 and seat assembly 26 rotate about common axis 62 as back assembly 24 is pivoted rearwardly. For reference, it is noted that a chair control incorporating a seat-angle-adjustment seat support (34A) allows angular rotation of its seat about a seat-angle-adjustment axis in a direction along arrow 68 (FIG. 6) without altering the angular position of back assembly 24, and a chair control incorporating a seat-depth-adjustment seat support (34B) allows linear movement of its seat in a direction along arrow 69 (FIG. 6) likewise without altering the position of back assembly 24.

Figure 9:
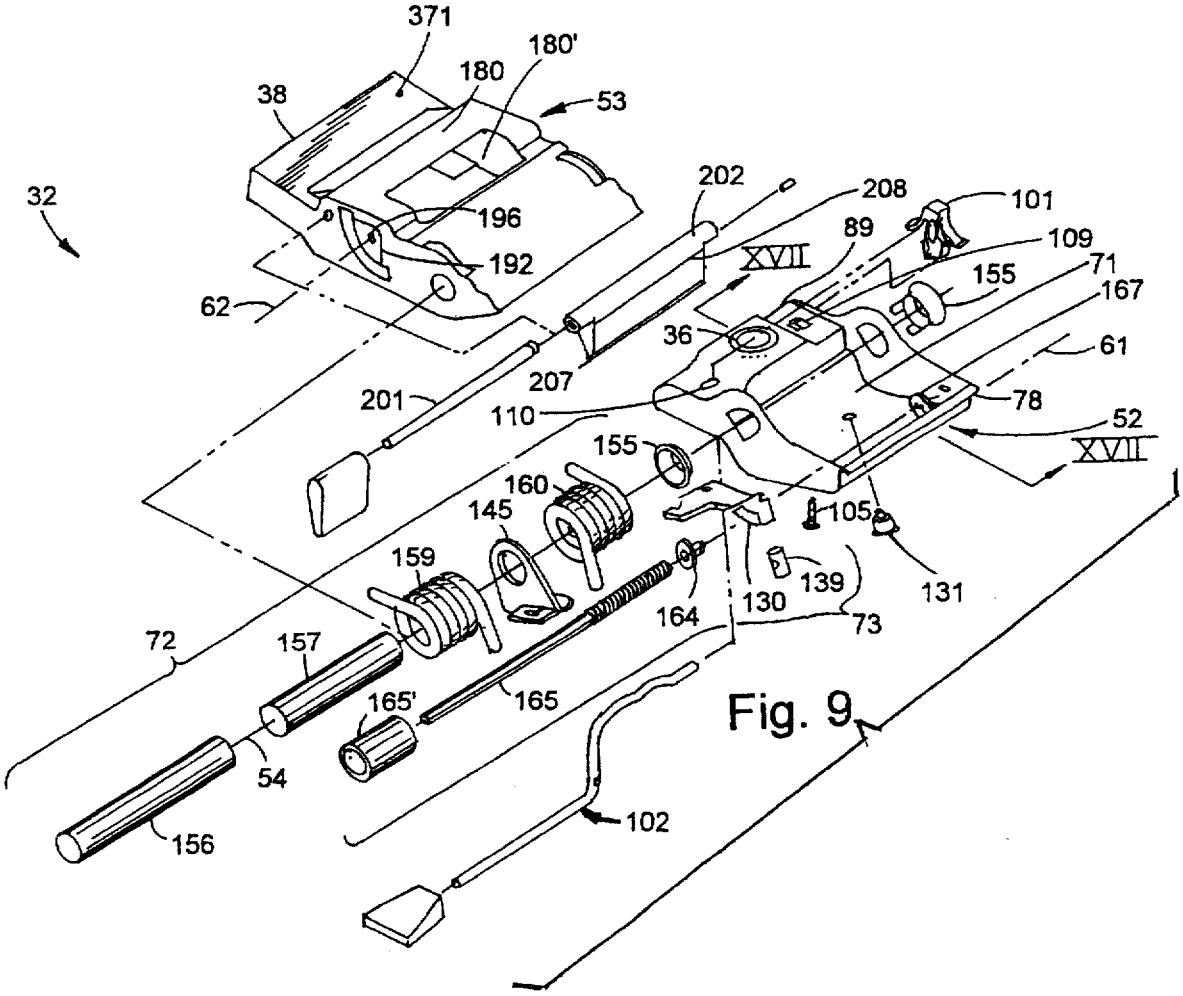
FIG. 9 is an exploded perspective view of the energy module shown in FIG. 8.
Figure 15:
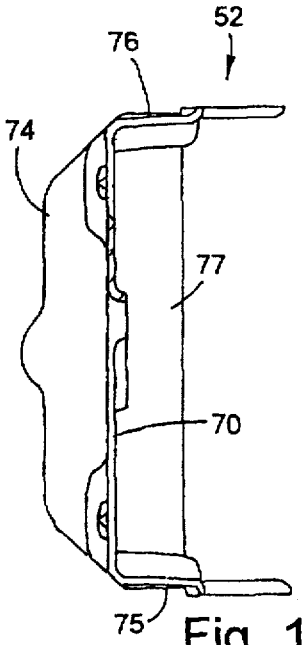
FIGS. 14–16 are orthogonal views of the fixed housing shown in FIG. 9, FIG. 16 being partially broken away to show a hole forming a part of the connector on the fixed housing for engaging the pedestal.
Figure 14:
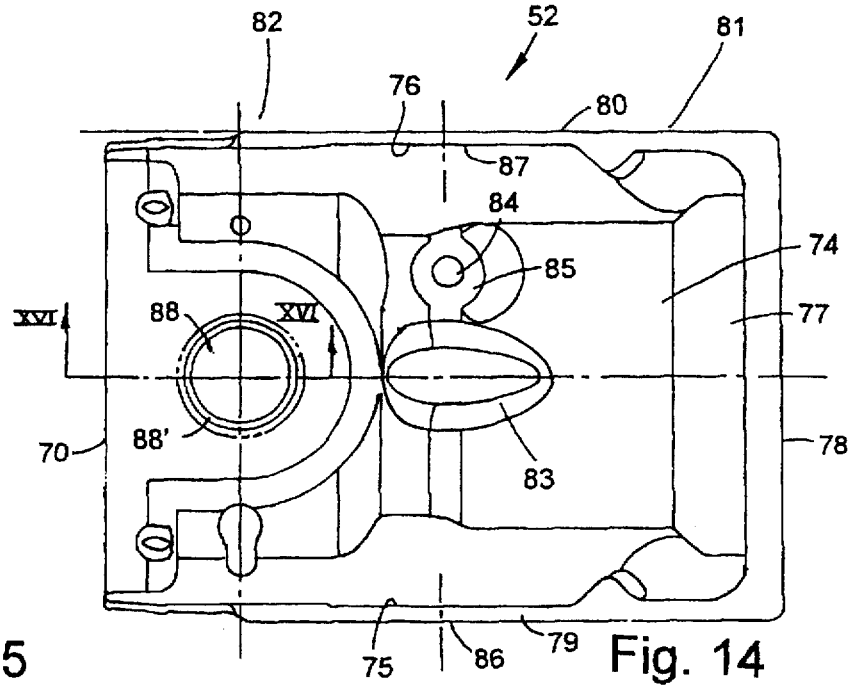
Figure 16:
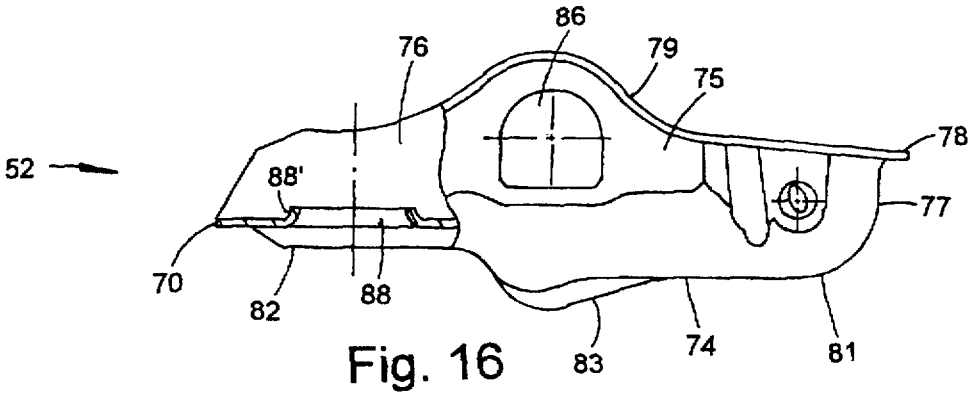
Figure 17:
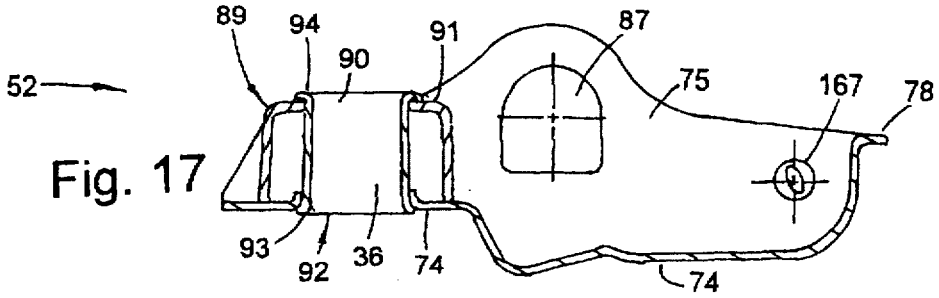
FIG. 17 is a cross-sectional view taken along the plane XVII—XVII in FIG. 9 showing the connector on the fixed housing for engaging the pedestal.

More specifically, energy module 32 includes a fixed housing or bracket 52 (FIG. 9) that defines a compartment 71 for receiving an energy source such as torsion spring assembly 72, a tension adjustment mechanism 73, and the pedestal connector 37. Specifically, fixed housing 52 (FIGS. 14–16) includes a floor 74, opposing sidewalls 75 and 76, and a front wall 77. The rear end of fixed housing 52 is generally open and includes a rear flange 70 adapted to engage a backstop mechanism and/or back lock mechanism and/or back limiting mechanism as described hereinafter. The front flange 78 on fixed housing 52 extends forwardly from front wall 77, and stiffening flanges 79 and 80 extend around the top edge of sidewalls 75 and 76 to rigidify same. Fixed housing 52 is divided into a front portion 81 and a rear portion 82. Front portion 81 includes centered depression 83 and a bell crank pivot-forming hole 84 located to the left side of the depression 83 on a flat angled section 85 of floor 74. The sidewalls 75 and 76 include enlarged mid-sections having aligned D-shaped apertures 86 and 87, respectively, formed therein for receiving a tubular axle 156 (FIG. 9) for torsion spring assembly 72, as discussed below. The rear portion 82 (FIG. 14) includes a centered hole 88 in floor 74 formed by an upwardly extruded flange 88' protruding from floor 74. An elongated inverted U-shaped brace 89 (FIG. 17) is welded between sidewalls 75 and 76 over centered hole 88. Brace 89 includes an upper horizontal web 91 spaced from floor 74 having a second centered hole 90 aligned with hole 88. A tube section 92 is extended through holes 88 and 90, and the ends 93 and 94 of tube 92 are flared or otherwise formed to secure tube section 92 in position. The inner surface of tube section 92 forms female connector 36. The upper exterior surface 95 of pedestal 50 (FIG. 22) defines the mating male connector 37 for engaging connector 36.

The upper end of pedestal 50 (FIG. 22) includes an actuator button 97 that is depressible to release a height adjust gas spring device within pedestal 50. Once actuator button 97 is depressed, the pedestal 50 can be telescopingly extended or retracted to raise or lower the chair. A vertical adjustment control mechanism 100 is operably attached to fixed housing 70 for engaging top actuator button 97. Vertical adjustment control mechanism 100 includes an adjustment member 101 and an actuator arm 102. Adjustment member 101 (FIGS. 18–21) includes a body 103 with a tubular boss 104 extending from one end for receiving an adjustment screw 105 (FIG. 22). A pair of snap lock fingers 106 extend at a reverse angle from the end of boss 104, and a second pair of tensioning fingers 107 extend at an angle from the body 103. Fingers 106 and 107 extend generally toward each other for engaging opposing sides of web 91 of brace 89. A boss-receiving hole 109 is located in the upper web 91 on one side of centered hole 90, and a slot 110 is located in the upper web 91 on the opposite side of centered hole 90. A key hole 111 is located in fixed housing floor 74 directly under slot 110. The boss 104 is configured to extend into boss-receiving hole 109. During insertion, fingers 106 deflect to allow insertion, but after insertion, fingers 106 resiliently spring outwardly to hold adjustment member 101 in hole 109. In the installed position, tensioning fingers 107 engage the top surface of web 91 and fingers 106 engage the bottom surface of web 91. The opposing interaction of fingers 106 and 107 cause adjustment member 101 to remain in an erect position on web 91 until screw 105 is installed. Thereafter, screw 105 holds adjustment member 101 in an upright position, and cooperates with upper fingers 107 to locate adjustment member 101 vertically on web 91.

Body 103 (FIG. 21) defines an elongated vertically extending slot 112 located on the side of body 103 that faces pedestal 50 (FIG. 22). Arm 102 includes a bearing midsection 113, a free end 114, and a handle-forming second end 115. Bearing section 113 includes a flattened surface 116 for engaging top actuator button 97. In the installed position, the free end 114 of arm 102 extends slidingly into slot 112 of adjustment member body 103. When arm 102 is in a non-actuating position, adjustment member 101 is adjusted vertically by turning screw 105 until the upper end of slot 112 of adjustment member 101 firmly engages the free end 114 of arm 102. Handle-forming end 115 includes a vertically extending bent section 117 that is configured to extend generally vertically through slot 110. A pair of pivot-forming flanges 118 are formed in bent section 117 for engaging the narrow end of slot 110 on the underside of web 91. Handle-forming end 115 further includes a handle-supporting section 119 that extends laterally from fixed housing 52. The end of handle-supporting section 119 is serrated to frictionally receive and hold a polymeric handle press fit thereon.

The adjustment screw 105 (FIG. 24) includes a threaded shaft 122 that extends through a hole 123 in fixed housing floor 74 aligned with boss-receiving hole 109. Shaft 172 is long enough to extend into and securely engage boss 104. The head 124 of screw 122 is larger than hole 123, such that as screw 122 is rotated into boss 104, it draws the body 103 of adjustment member 101 toward (or extends it away from) brace 89. Thus, arm 102 can be readily adjusted from the exterior of chair control 30 by adjustment of screw 122 to eliminate any looseness or play in arm 102 that is present on assembly or that develops in the future as parts wear down. Adjustment screw 122 can be replaced with a threaded member that can be operated by hand, such as a screw with a knob-shaped head, or other arrangements.

To install arm 102 (FIG. 24), free end 114 is extended through holes 111 and 110, with flanges 118 being extended through the large end of key hole 111 and positioned against the underside of web 91. Adjustment member 101, which has been snap-locked into hole 109 of brace 89, is tilted in direction 120 so that the free end 114 can be inserted into slot 112 in body 103 of adjustment member 101. Adjustment member 101 is then moved back to a generally vertical position (FIG. 22), and screw 105 is then adjusted to eliminate any looseness in arm 102 due to bottom 97 being positioned in varying positions caused by dimensional variations in the tapered connection between the gas spring and connection 36. In the installed position, the flat surface 116 of arm bearing section 113 rests on actuator button 97 of pedestal 96. Also, pivot-forming flanges 118 engage web 91 on the bottom sides of slot 110. Further, free end 114 engages the upper end of slot 112 in body 103 of adjustment member 101. Arm 102 thus forms a lever arrangement with the free end 114 restrained at one end against upward movement by adjustment member 101, the handle-forming end 115 restrained at the other end against upward movement by pivot-forming flanges 118, and the bearing section 113 is biased against downward movement by actuator button 97.

Advantageously, arm 102 can be used to activate actuator button 97 in either of two ways. By moving arm handle end 115 downwardly in direction 125 (FIG. 22), arm free end 114 is restrained by adjustment member 101, thus causing arm bearing section 113 to depress actuator button 97 and operate the height adjust device in pedestal 96. Alternatively, by moving arm handle-forming end 115 upwardly in direction 126 (FIG. 23), pivot-forming flanges 118 engage web 91 and arm free end 114 slides within slot 112 of adjustment member 101, thus also causing arm bearing section 113 to depress actuator button 97 and operate the height adjust device in pedestal 96.

The spring tension adjust mechanism 73 (FIG. 9) includes a bell crank or lever 130 pivotally secured to fixed housing 70 by a pivot pin 131 engaged in hole 84 in fixed housing floor 74 (FIGS. 26–27). Bell crank 130 is a double-walled L-shaped part (FIGS. 31–32) including a first leg 132 and a generally perpendicular second leg 133 connected at a juncture section 134. A pivot hole 135 is formed in juncture section 134 for receiving pivot pin 131 (FIG. 27). Juncture section 134 mateably engages flat angled section 85 on floor 74, but is attached to floor 74 by pivot pin 131 so that bell crank 130 rotates easily. First leg 132 (FIGS. 31–32) includes a loop-shaped end 136 defining a channel 137 that extends perpendicularly to the axis of rotation defined by pivot pin 131. Opposing sides of the loop 136 include semi-circular aligned notches 138. A cylindrically-shaped nut 139 is rotatably mated into notches 138 and extends transversely across channel 137. Nut 139 includes a threaded hole 140 that generally aligns with channel 137. Nut 139 can be metal or plastic, and includes about 12 threads per inch. The second leg 133 includes a depression 141 in an edge located remote from first leg 132, thus giving second leg 133 a hook-shaped tip 142. First leg 132 is longer than second leg 133 such that bell crank 130 provides mechanical advantage when adjusting the tension of springs 159 and 160, thus reducing the effort required to adjust the tension of springs 159 and 160. In particular, the combination of the threads on rod 165 (discussed below) and on nut 139, and the unequal length of legs of bell crank 130 provides a mechanical advantage such that the activation force for spring tension adjustment mechanism 73 is about 20 inch pounds or less.

Spring tension adjustment mechanism 73 further includes a T-shaped spring-engaging tension adjust bracket 145 (FIGS. 28–30). T-shaped bracket 145 includes a double-walled center web 146 having an axle-engaging pivot-forming hole 147, and a perpendicular flange 148 extending in both directions from center web 146. A hook 149 is formed at the bottom of center web 146. Hook 149 extends to the remote bottom side 150 of perpendicular flange 148. A pair of holes 151 are formed on flange 148 on both sides of center web 146.

Torsion spring assembly 72 (FIG. 9) includes a pair of pivot bearings 155 engageable with aligned apertures 86 and 87 in the sidewalls of fixed housing 52 (FIGS. 33–34). A pair of opposing torsion coil springs 159 and 160 are positioned on either side of T-shaped bracket 145 with the inner ends 161 and 162 of the springs 159 and 160 extending into slot 151 of T-shaped bracket 145. The outer ends 174 and 175 of springs 159 and 160 engage the underside of top plate 180 of back upright support bracket 53. Springs 159 and 160 and T-shaped bracket 145 are positioned in internal compartment 71 of fixed housing 52 between fixed housing 52 and back upright support bracket 53. Axle bearings 155 are engaged with apertures 86 and 87 in fixed bracket sidewalls 75 and 76. A pivot tube or tubular axle 156 and a bearing sleeve 157 are extended through bearings 155 and through corresponding holes 158 in back upright support bracket 53 to pivotally mount back upright support bracket 53 to fixed housing 70. The assembly can be readily made since coil springs 159 and 160 are not tensioned during initial assembly.

Spring tension adjustment mechanism 73 (FIG. 33) includes a horizontally positioned rod 165 that extends through a hole 166 in the front portion of sidewall 75 of fixed housing 52. A sleeve bearing 164 is positioned in hole 166 and rotatably supports rod 165. A pivot/slide hardened metal bearing 167 is positioned in a second hole 168 that is located in a front portion of sidewall 76 in alignment with first hole 166. Bearing 167 (FIGS. 36–38) includes a head 169 with an elongated depression 170 on its face, and an oblong stem 171 configured to non-rotatably engage second hole 168 for retaining bearing 167 in hole 168. Rod 165 (FIG. 33) includes a threaded section 172 configured to engage threaded hole 140 in nut 139 on bell crank 130. The tip 173 of rod 165 is generally pointed, and engages the depression 170 in bearing 167. The point contact of tip 173 on bearing 167 minimizes friction, thus permitting rod 165 to rotate and slide on bearing 167 relatively freely. The elongated depression 170 permits rod tip 173 to move back and forth translationally across bearing head 169 as bell crank 130 pivots and draws rod tip 173 in a fore/aft direction relative to fixed housing 52. Specifically, as rod 165 is rotated and thus nut 139 moves axially along rod 165, bell crank 130 pivots about pivot pin 131. This causes the second leg 133 of bell crank 130 to engage T-shaped bracket 145, causing T-shaped bracket 145 to rotate about pivot tube 156. In turn, T-shaped bracket 145 rotates on axle 156 and hence torsionally tensions springs 159 and 160 on pivot tube 156. Since the second ends 174 and 175 of springs 159 and 160 are restrained by engagement against the underside of back upright support bracket 53 (FIG. 35), springs 159 and 160 are increasingly tensioned as T-shaped bracket 145 rotates. Advantageously, the tension of springs 159 and 160 works through T-shaped bracket 145 and bell crank 130 to bias rod 165 against bearing 167 and to bias nut 139 against bell crank 130. Thus, the components are held in place without additional secondary assembly operations or separate parts.

To assemble rod 165, rod 165 is extended through sleeve bearing 164 and hole 166 into threaded engagement with threaded hole 140 in nut 139 of bell crank 130. Springs 159 and 160 are not tensioned until rod tip 173 engages bearing 167. As rod 165 is further axially rotated, nut 139 moves up threaded section 172 of rod 165. This causes bell crank 130 to rotate, which in turn causes T-shaped bracket 145 to rotate. Springs 159 and 160 are thus tensioned by T-shaped bracket 145. Once assembled, the threads near rod tip 173 are deformed or filled to prevent accidental disassembly.

Back upright support bracket 53 (FIGS. 39–42) is an inverted compartment-defining structure configured to be mateably rotatably connected to fixed housing 52. In particular, back upright support bracket 53 includes an upper panel 180 having an integral transverse stiffening rib 180" across the part of upper panel 180 forming connector 38. A pair of opposing sidewalls 181 and 182 extend downwardly from upper panel 80, sidewalls 181 and 182 being spaced apart and configured to straddle the sidewalls 75 and 76 on fixed housing 52. An aperture 180' is formed in upper panel 180 of back upright support 53 to allow top of the pedestal (50) to extend through aperture 180' when chair control 30 is pivoted to the fully reclined position. (See FIG. 51.) The pivot-tube-receiving holes 158 are located in a forward end of sidewalls 181 and 182 of back upright support bracket 53 (FIGS. 39–42). Apertures 181' and 182' are located in upper panel 180 generally above holes 158 for providing access to pivot bearing 155. A pair of aligned pivot-forming holes 184 are located in a rearward portion of sidewalls 181 and 182 for defining common axis 60, and a secondary pair of aligned holes 185 are formed proximate holes 184 for forming a pivot to rotatably support the backstop mechanism, as discussed hereinafter.

The rear portion of sidewalls 181 and 182 and upper panel 180 extend rearwardly at an acute angle slightly above horizontal to define connector 38 (FIG. 39). Flanges 187 and 188 (FIG. 41) extend inwardly from the bottom of sidewalls 181 and 182 to define the rectangular shape of connector 38. Screw holes 189 and 190 (FIG. 40) are provided in upper panel 180 and in flanges 187 and 188 (FIG. 42), respectively, to secure a back upright to connector 38.

Figure 43:
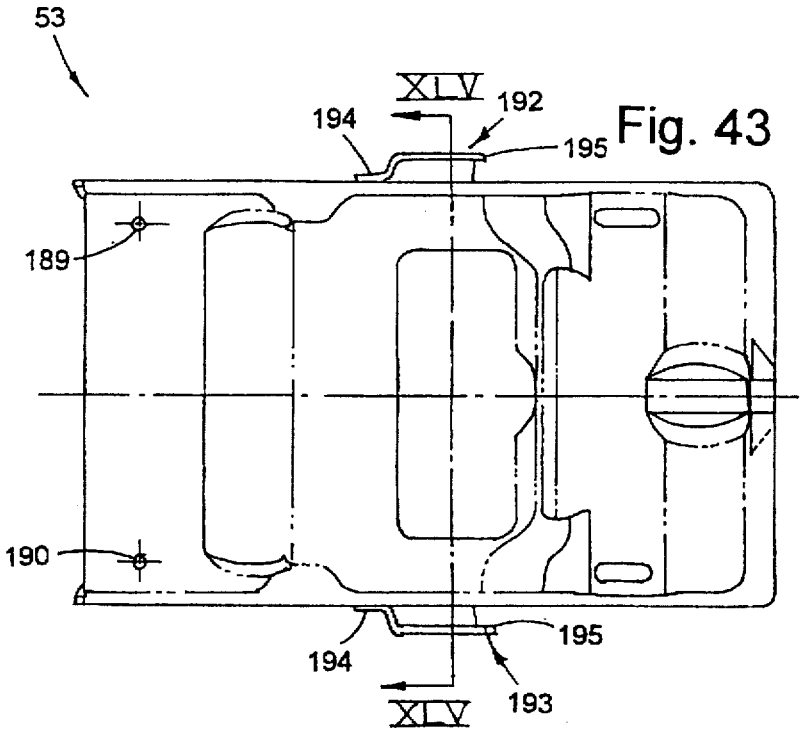
FIG. 43 is a plan view of the back upright support bracket comparable to FIG. 39 but after attachment of the ear flanges to the sidewalls.
Figure 44:
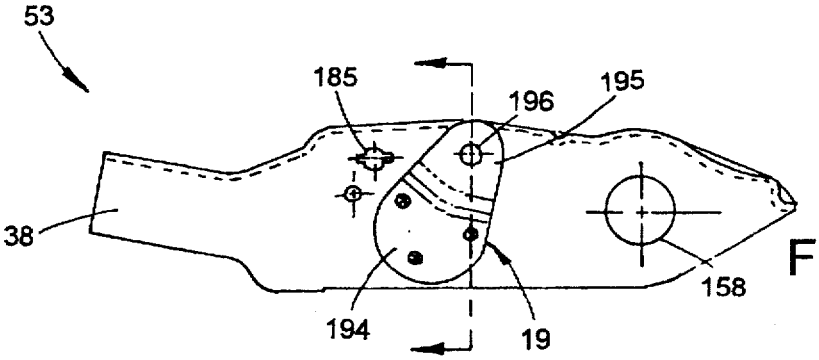
FIG. 44 is a side elevational view of the back upright support bracket shown in FIG. 43.
Figure 45:
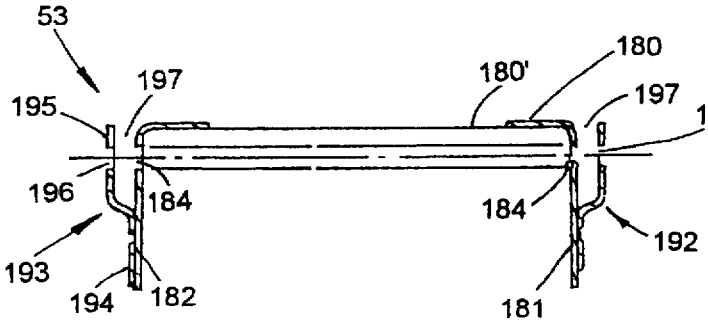
FIG. 45 is a cross-sectional view taken along the plane XLV—XLV in FIG. 43.
Figure 66:
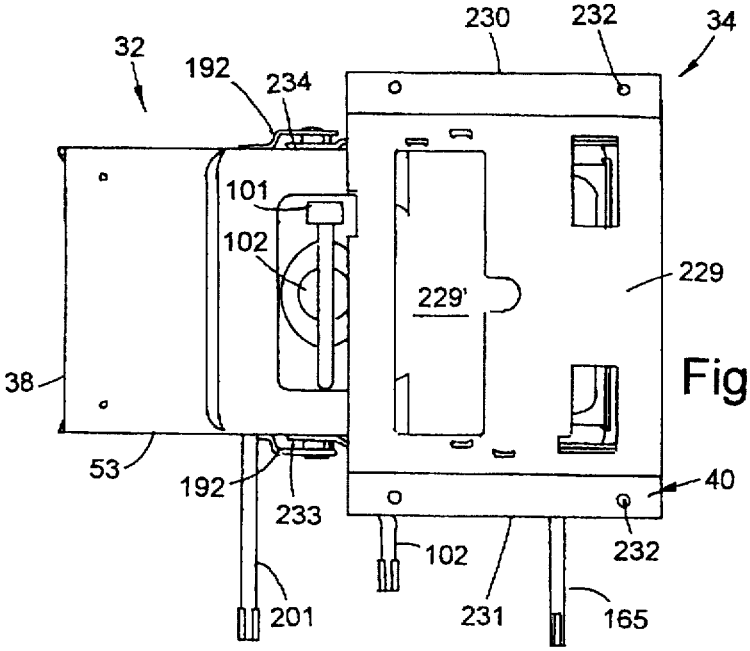
FIG. 66 is a plan view of a chair control module including the non-adjustable seat support and the energy module shown in FIG. 55.
Figure 67:
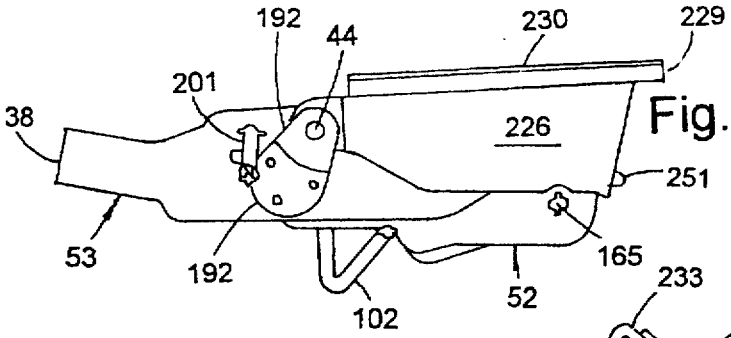
FIG. 67 is a side view of the chair control shown in FIG. 66.
Figure 68:
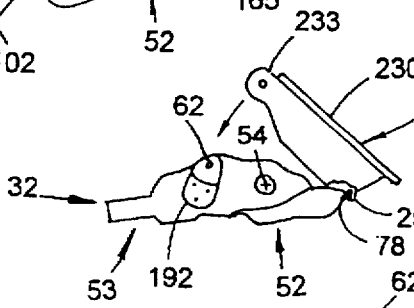
FIG. 68 is a side view, partially broken away, of the chair control shown in FIG. 66 illustrating assembly of the non-adjustable seat support to the energy module.

A pair of Z-shaped ear flanges or brackets 192 and 193 (FIGS. 43–45) are secured to opposing sidewalls 181 and 182. Ear flanges 192 and 193 each include a first end 194 configured to be spot-welded to back upright support bracket 53, and further include offset second end 195 that extends from first end 194. Second end 195 is offset so that it is spaced from the corresponding sidewall of 181/182, and includes a hole 196 that aligns with hole 184 and is spaced axially therefrom. The space 197 between each offset second end 195 and each corresponding sidewall is configured in a clevis-like arrangement to receive a synchrotilt bushing 198 and tail flanges 233 and 234 of seat support bracket 225. A removable, re-useable pivot pin 44 is extended through holes 184 and 196, as described below in reference to FIGS. 54–61.

A back lock mechanism 200 (FIGS. 46–49) is operably connected to energy module 32. Back lock mechanism 200 includes a pivot rod 201 and a locking element 202 press-fittingly secured to pivot rod 201. Specifically, locking element 202 is molded from a polymeric material such as nylon 6/6, and includes a hub 203 and a foot 204 extending from hub 203. Foot 204 includes a front panel 205 and a plurality of parallel reinforcing ribs 206. A first notch 207 (FIG. 48) is defined at an end of foot 204, and a second notch 208 is defined at a location nearer hub 203. Hub 203 includes a tab 209 that extends from hub 203 opposite foot 204. A leaf-spring-like member 210 (FIGS. 49 and 50) is secured to back upright support bracket 53 over hub 203 in a position engaging tab 209. Spring member 210 includes a rounded center section 211 for engaging tab 209, and opposing arm-like ends 212 and 213. A hole 211' formed transversely in hub 203 includes opposing notches 215, and rod 201 includes flanges for frictionally engaging locking element 202 at notches 215 (FIG. 48) to prevent rotation of locking element 202 on rod 201.

To assemble back lock mechanism 200, pivot rod 201 is extended through holes 185 (FIG. 39) in back upright support bracket 53 and press-fittingly onto locking element 202 (FIG. 48), so that locking element 202 can be operably rotated by manipulating rod 201. In the installed position, spring 210 (FIG. 50) engages hub 203 and in particular tab 214 to generate friction to hold pivot rod 201 and locking element 202 in a selected position. With back upright support bracket 53 in a fully upright position, back lock mechanism 200 can be rotated between a back locked position (FIG. 50) and a back unlocked position (FIG. 51). In the locked position (FIG. 50), notch 207 engages the rear flange 70 of fixed housing 52 and prevents any rearward tilting movement of the back upright support bracket 53. In the unlocked position (FIG. 51), the back upright support bracket 53 can be pivoted to the fully reclined position before second notch 208 engages rear flange 218 to prevent further rear tilting movement.

Energy module 32B (FIG. 2) includes a modified back lock mechanism 200' (FIG. 53) that is generally similar to back lock mechanism 200, except that back lock mechanism 200' includes a multi-stepped locking element 202' having a plurality of notches 220 in foot 204' for defining a plurality of selectable stop positions. A plurality of tabs 209' are located on hub 203' for holding locking element 202' in a selected position. Alternatively, it is contemplated that a friction-generating device could be positioned at an axial end of locking element 202' to hold back lock mechanism 200' in a selected position. Energy module 32A (FIG. 2) does not include a lock mechanism 200 or 200' on back upright support bracket 53.

The seat support module 34 (FIGS. 54–55) includes a non-adjustable seat support bracket 225. Seat support bracket 225 (FIGS. 56–58) includes sidewalls 226 and 227, front wall 228, and seat-engaging top plate 229 having an aperture 229'. Seat-engaging top plate 229 includes raised and offset opposing flanges 230 and 231 defining a rectangular planar arrangement with holes 232 defining the connector 40 for engaging a seat. Sidewalls 226 and 227 each include tail flanges 233 and 234 having a square hole 235 therein. Tail flanges 233 and 234 are shaped to mateably fit within space 197 (FIG. 45) between ear flange 192 (and 193) and the corresponding sidewall 181 (and 182). The square hole 235 can be readily aligned with holes 196 in ear flange 192 (and 193) and holes 184 in the corresponding sidewall. It is contemplated that seat support bracket 225 could be formed integrally with the structural pan on a seat assembly, and thus the term seat support bracket is not intended to be unnecessarily limiting. Specifically, seat support bracket 225 could be molded, formed or securely attached as part of a seat assembly. Also, it is noted that the non-adjustable seat support bracket 225 provides the synchrotilt action in a manner comparable to the synchrotilt bracket 270 described hereinafter.

Synchrotilt bushings 240 (FIGS. 59–60) include a tubular section 241 and a flanged end 242. Tubular section 241 includes radiating flanges 242 forming a square pattern for interlockingly non-rotatably engaging square hole 235 in tail flanges 233 and 234 (FIGS. 56 and 58). It is noted that other keyed hole configurations can be used in place of square hole 235, such as a round hole having a notch formed in one side. In such case, the synchrotilt bushing (240) is adapted to interlockingly engage the new hole configuration. A ring-shaped ridge 243 (FIG. 60) is formed midway along the bore 244 in tubular section 241. The pivot pins 44 (FIG. 61) each include a shaft 245 and a flanged end 246. A ring-shaped recess 247 is located midway on shaft 243. The ridge 243 on bushing tubular section 241 (FIG. 60) mateably engages recess 247 on pivot pin 44 (FIG. 61) with an interference-fit to retain pivot pin 44 in bushing 240. However, pivot pins 44 are removable and can be pried loose by use of an appropriate tool. As installed, pivot pins 44 define the common tilt axis 62 (FIG. 54). Pivot pins 44 retain tail flanges 233 (and 234) in space 197 between ear flanges 192 (and 193) and upright sidewall 181 (and 182) in a clevis-like arrangement that holds the pivot pins 44 axially parallel common tilt axis 62.

The front wall 228 of non-adjustable seat support bracket 225 (FIG. 57) includes an elongated aperture 250 near its lower edge. An elongated synchrotilt bushing 251 (FIG. 62) having a T-shaped cross section includes a nose surface 252 with barbs 253 thereon for reversely engaging front wall 228 of seat support bracket 225 at aperture 250. Specifically, a flanged rear end 254 and the opposing barbs 253 oppose each other to hold bushing 251 in aperture 250. Nose surface 252 is configured to protrude through aperture 250, and barbs 253 are configured to snap lock into front wall 228 in opposition to flanged rear end 254. A recess 255 is defined in the rear end of synchrotilt bushing 251 for mateably receiving front flange 78 of fixed housing 52. The engagement of front flange 78 with bushing 251 defines the seat tilt axis 61.

Figure 63:
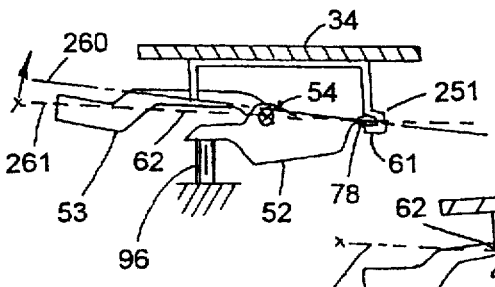
FIGS. 63–65 are schematic side views showing the relative positions of the seat tilt axis, the back tilt axis, and the common axis as the back upright support bracket is pivoted from a fully upright position (FIG. 63), to a mid position (FIG. 64) and to the fully reclined position (FIG. 65)
Figure 65:
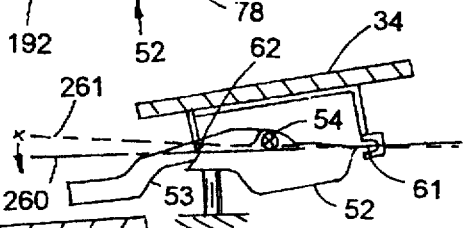
Figure 64:
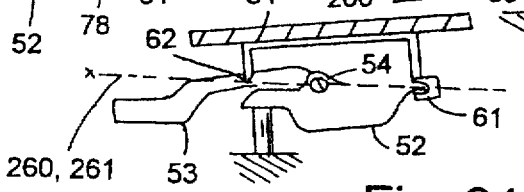

The relationship of back tilt axis 54, seat tilt axis 61, and common axis 62 is nearly linear when back upright support bracket 53 is in the fully upright position (FIG. 63). This is illustrated by line 260, which extends through axes 54 and 61, and by line 261, which extends through axes 54 and 62. As back upright support bracket 53 moves toward the fully reclined position, common axes 62 moves over-center with respect the line connecting axes 57 and 61. This is illustrated in FIG. 64 by the alignment of lines 260 and 261 (i.e. the back upright support bracket 53 being in an intermediate tilted position), and in FIG. 65 by the reversal of the lines 260 and 261 (i.e. the back upright support bracket being in the fully reclined position). This near alignment arrangement provides the minimal movement of front flange 78 within recess 255, which movement is represented by arrow 262 in FIG. 62. Notably, common axis 62 is positioned about the same amount above line 260 in the fully upright position (FIG. 63) as it is below line 260 in the fully reclined position (FIG. 65). This symmetry also minimizes the translational movement 262, and thus minimizes wear at front flange 78. By positioning the common axis 62 (i.e. by use of pivot pins 44) at the sides of back upright support bracket 53, axis 62 can be located in an intermediate position on energy module 30 that provides a low compact profile (i.e. low vertical overall dimension) without interfering with other components in energy module 30. Thus, chair control 30 can be designed with a relatively thin vertical dimension that provides a low, sleek, aesthetic profile. A thin vertical dimension is important since control modules, particularly those with several adjustment features, must still have a sleek appearance to be aesthetically acceptable even though a plurality of internal parts must be accommodated. Thus, the addition of pivot pins 44 and their location are not unimportant. Also, the clevis-like arrangement of tail flanges 233 (and 234) between ear flanges 192 (and 193) and upright sidewalls 181 (and 182) maintain the stability of pivot pins 44 even though the pivot pins 44 have a relatively short length.

Figure 70:
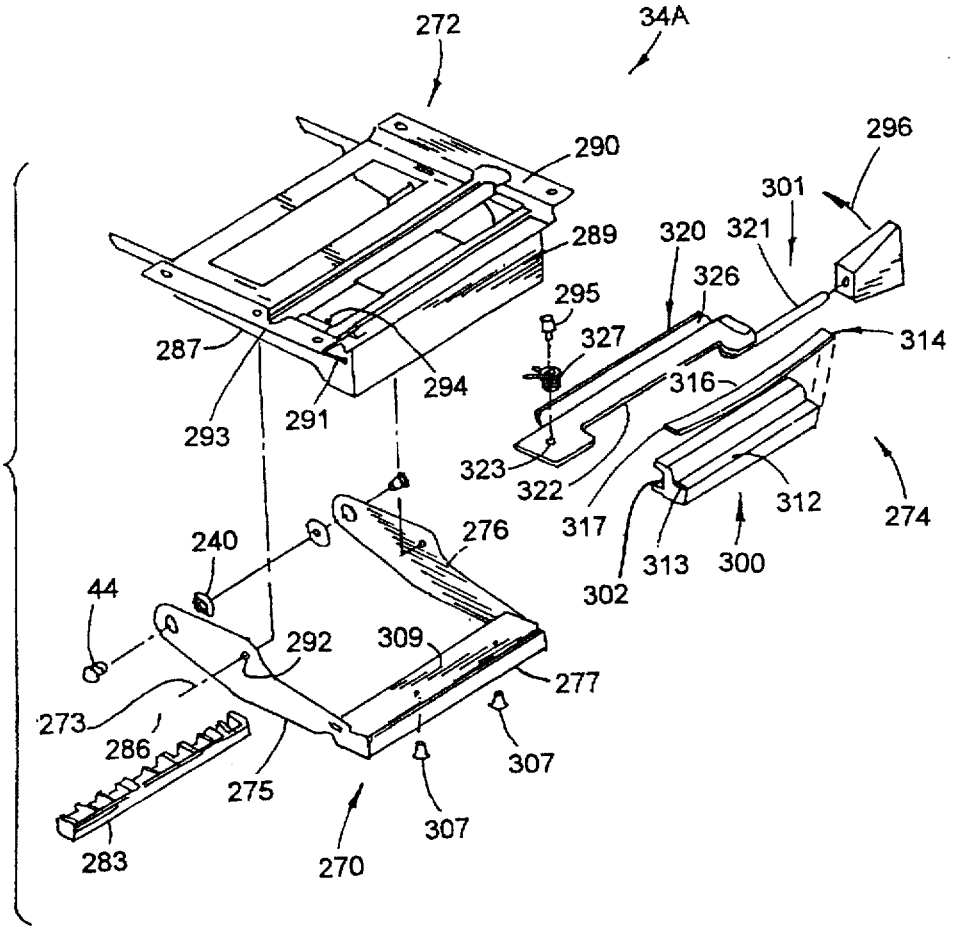
FIG. 70 is an exploded perspective view of the seat-angle-adjustable seat support shown in FIG. 69.
Figure 69:
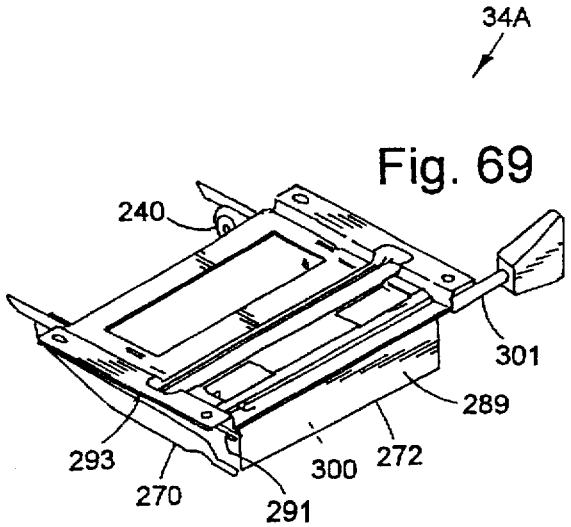
FIG. 69 is a perspective view of a seat-angle-adjustable seat support shown in FIG. 2.
Figure 92:
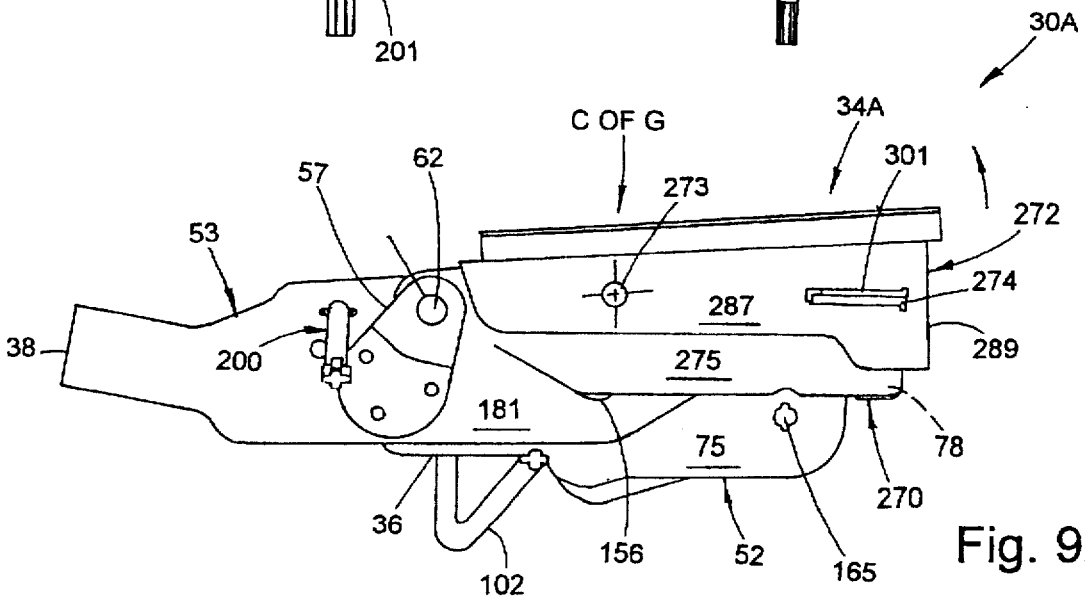
FIG. 92 is a side elevational view of the chair control shown in FIG. 91.

The seat-angle-adjustable seat support 34A (FIGS. 69–70) includes a synchrotilt bracket 270 configured to be pivotally mounted on the front flange 78 of fixed housing 52 (FIG. 92) and to be pivotally mounted on the ear flanges 57 (i.e. common axis 62). A seat-engaging angle-adjustable seat support bracket 272 (FIG. 70) is pivotally secured to synchrotilt bracket 270 at a seat-angle-adjustment axis 273 located under a projected center of gravity of a person sitting in a normal fully upright position on a chair incorporating seat support 34A. This allows seat support bracket 272 to be angularly adjusted substantially without a forward or rearward bias from the weight of a person sitting in the chair. A seat-angle-adjustment mechanism 274 is operably attached between the front portions of synchrotilt bracket 270 and seat support bracket 272 for adjusting the relative angle between the synchrotilt bracket 270 and the seat support bracket 272.

More specifically, synchrotilt bracket 270 (FIGS. 71–73) is U-shaped, and includes parallel arms 275 and 276 connected by a transverse C-shaped member 277 located at the front end of arms 275 and 276. Arms 275 and 276 include rear end sections 278 and 279 shaped generally similar to tail flanges 233 (and 234) on seat support bracket 225 (FIG. 56). Aligned square holes 280 (FIG. 73) are located in rear end sections 278 and 279 for receiving synchrotilt bushings (240). Synchrotilt bracket arms 275 and 276 are spaced apart to matingly straddle the sides of back upright support bracket 53 (FIG. 92), and are sufficiently elongated to locate transverse member 277 at front flange 56. A pair of aligned pivot holes 281 (FIG. 73) are formed midway along parallel arms 275 and 276 for defining a seat-angle-adjustment axis 273.

The transverse C-shaped flange member 277 (FIGS. 71–73) of synchrotilt bracket 270 defines a rearwardly facing pocket 282 for receiving a C-shaped synchrotilt bushing 283 (FIGS. 74–76). Synchrotilt bushing 283 includes ribs 284 defining an outer surface shaped to slidably, mateably engage pocket 282 such that bushing 283 is frictionally retained in pocket 282. A depression 285 is defined in the rear side of bushing 283, which depression 285 is configured to receive front flange 78 as shown in FIGS. 77 and 78. As shown in FIG. 77, back upright support bracket 53 is in the fully upright position such that the clearance dimension D1 is defined between front flange 78 and the inner surface of pocket 282. The clearance dimension D1 is also defined when back upright support bracket 53 is in the fully reclined position. When back upright support bracket 53 is in a mid-position (FIG. 78), the clearance dimension D2 is defined. As shown in FIGS. 77 and 78, dimension D1 is larger than dimension D2, but in practice the difference between dimensions D1 and D2 (i.e. the relative movement) is relatively small. Also, the actual clearance dimension D2 which occurs when back upright support bracket 53 is in the mid-position, can be reduced to a tight fit if desired.

Figure 87:
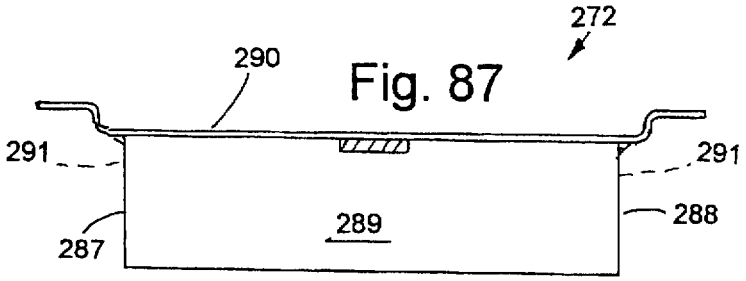
FIGS. 87–88 are front and bottom plan views of the angularly adjustable seat support bracket shown in FIG. 70.
Figure 88:
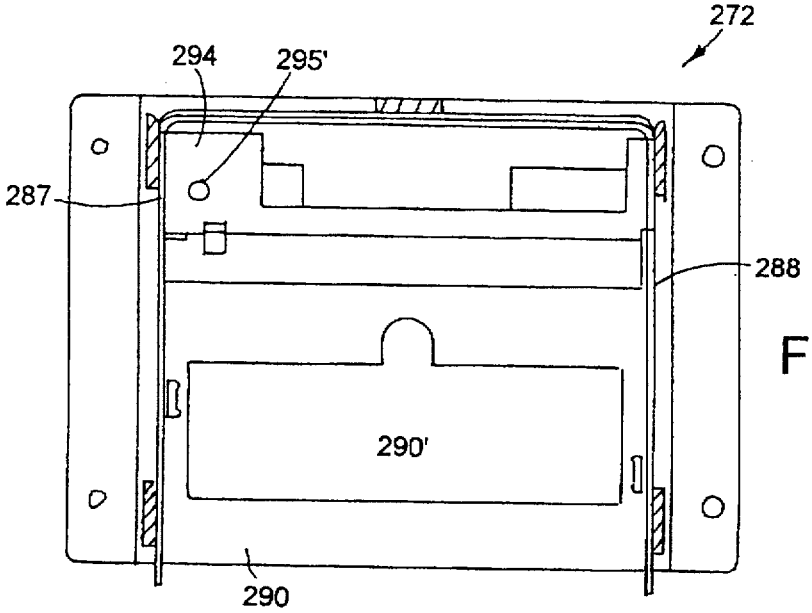
Figure 89:
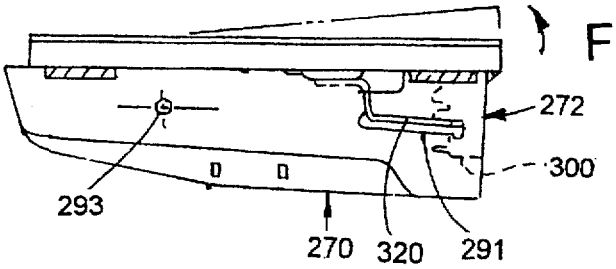
FIG. 89 is a side view of the seat-angle-adjustable seat support including the synchrotilt bracket and seat support bracket shown in FIG. 70, the seat support bracket being shown in a lowered first position.
Figure 90:
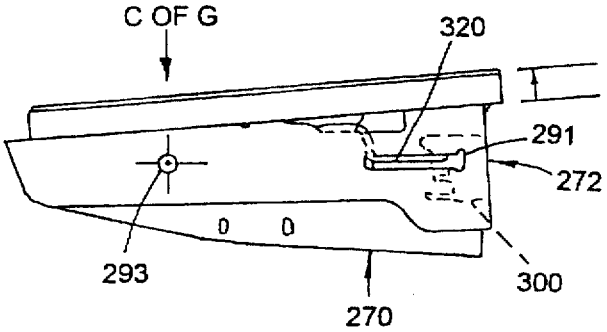
FIG. 90 is a side elevational view of the seat support shown in FIG. 89, the seat support bracket being shown in a raised second position.

Seat-engaging seat support bracket 272 of seat support 34A (FIGS. 87 and 88) includes sidewalls 287 and 288, a front wall 289, and an upper plate 290 having an aperture 290'. Seat support bracket 272 is generally similar to seat support bracket 225 (Pig. 54), but sidewalls 287 (and 288) are spaced somewhat wider apart to matingly receive synchrotilt bracket arm 275 (FIG. 92) between sidewall 287 and back upright support sidewall 181, and to matingly receive the other synchrotilt bracket arm (276) between the corresponding opposite sidewall (288) and back upright support sidewall (226). Sidewalls 287 and 288 (FIG. 70) include aligned slots 291 to receive the ends of latching member 301. Seat support bracket 272 is pivotally secured to synchrotilt bracket 272 by pivot pins 286 that engage holes 292 in synchrotilt arms 275 and 276, and corresponding holes 293 in sidewalls 287 and 288 of seat support bracket 286. Pivot pins 286 are preferably located at or proximate a center of gravity of a person seated in chair 20 so that the seat adjustment axis of rotation is not adversely affected by the weight of the person. This allows the seat angle to be relatively easily and safely adjusted, even while sitting on the seat.

Seat-angle-adjustment mechanism 274 (FIG. 70) includes a molded angle-defining stop block 300 securely attached to the top of synchrotilt bracket 286, and a latching member 301 rotatably attached to an inner bracket 294 on seat support bracket 286 by a pivot pin 295 for pivotally engaging angle-defining block 300. More particularly, block 300 (FIGS. 82–86) includes a stepped face 302 having discrete notches 303 defined therein, which notches 303 are releasably engageable by latching member 301. Block 300 includes a generally rectangular body section 304 having a bottom surface 305 with a pair of screw holes 306 extending perpendicularly from surface 305 into body section 304. Screws 307 (FIG. 70) are extended through holes in the upper web 309 of transverse C-shaped member 277 and into holes 306 to secure step block 300 to the top of synchrotilt bracket 270. Tabs 310 (FIG. 86) on the ends of block 300 extend below bottom surface 305 to capture the transverse member 277 therebetween. A channel 312 is defined in the top surface 313 of block 300, and an arcuately-shaped leaf spring 314 (FIG. 70) is provided that includes a midsection 316 that mateably fits into channel 312. The curved ends 317 and 318 of leaf spring 314 extend above channel 312 into engagement with the underside of upper plate 290 of seat support bracket 286. Thus, leaf spring 314 biases seat support bracket 286 upwardly to a normally rearwardly angled position. The stepped face 302 faces rearwardly on block 300. Stepped face 302 is angled to provide relief for latching member 301, as noted below.

Latching member 301 (FIGS. 79–81) includes a latch bracket 320 and a bent rod handle 321 welded to latch bracket 320. Latch bracket 320 includes an elongated latching plate 322 having a hole 323 therein at its handle remote end 324. The pivot pin 275 (FIG. 70) extends through hole 323 on latching plate 322 and also through hole 295' on bracket 294 (FIG. 88) to pivotally connect elongated plate 322 to seat support bracket 286 along seat support bracket sidewall 287. A stiffening flange 326 (FIG. 80) extends along a rear edge of latching plate 322. A coil spring 327 (FIG. 70) is mounted on pivot 295, and includes spring ends that engage flange 326 and seat support bracket 286 to bias latching member 301 into latching engagement with stepped face 302 on block 300. The front edge 328 of latch plate 322 (FIG. 80) includes a blade-like front surface having a notch 329 configured to mateably engage stepped face 302 (FIG. 82). The angled relief provided across the face of step block 301 prevents an undesired interference between latch plate 322 (FIG. 70) and face 302 when latching member is pivoted to a disengaged position. Latching member 301 is pivotally movable between a retracted disengaged position for adjusting the seat angle position relative to fixed housing 52, and an engaged position whereat the latch plate 322 is engaged with a selected one of notches 303. Slot 291 in sidewall 288 of seat support bracket 286 receive the handle-forming end of latching member 301. Slot 331 stabilizes latching member 301 in a horizontal plane, limits the fore/aft movement of latching member 301, and further prevents undesired rotation of latching member 301 which would allow latching plate 322 to tilt and slide out of engagement with block 300.

Figure 91:
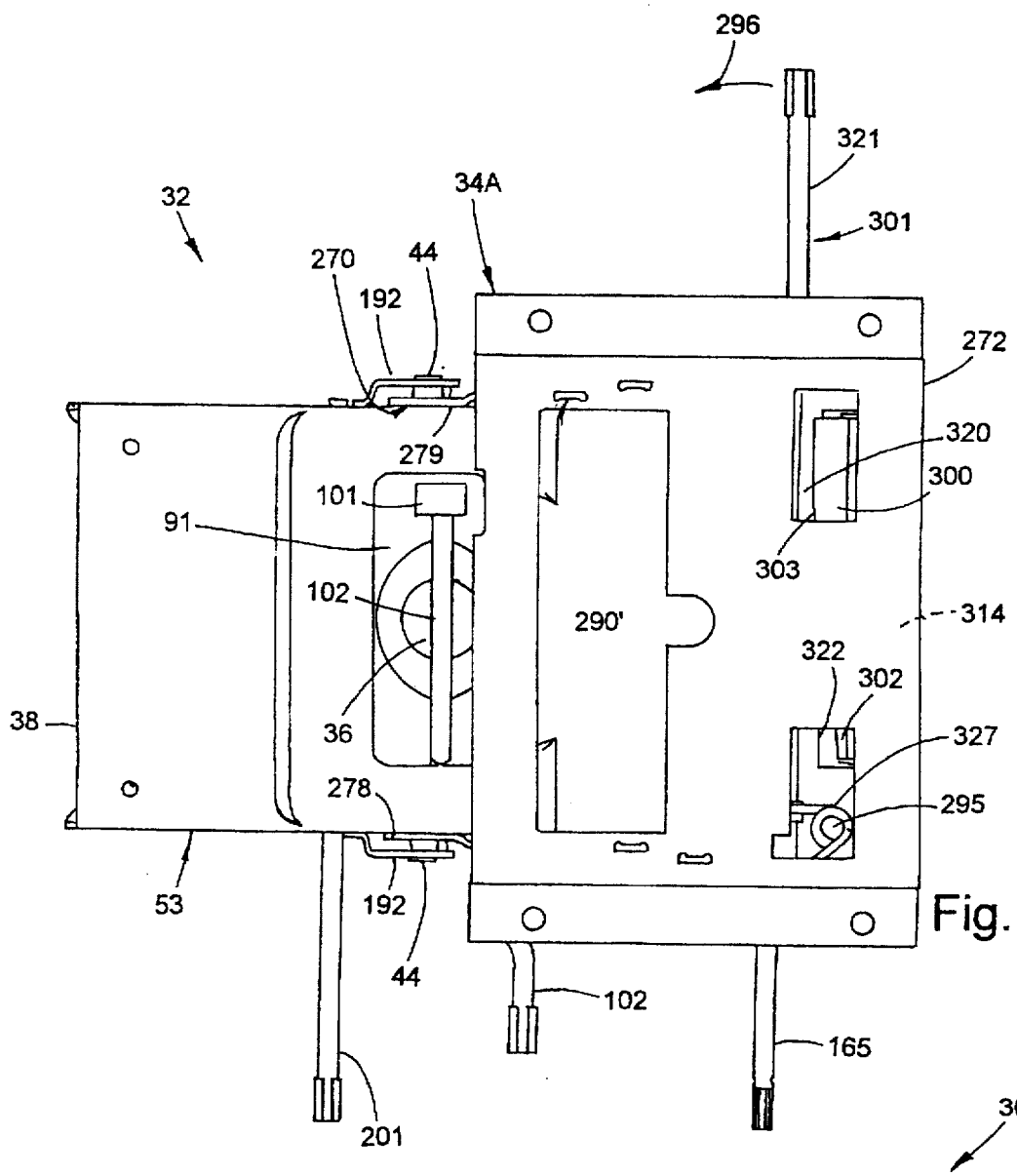
FIG. 91 is a plan view of a control module including the seat-angle-adjustable seat support and an energy module shown in FIG. 69.

To operate seat-angle-adjustment mechanism 274 (FIG. 91), the handle end 321 of latching member 301 is moved rearwardly in direction 296 to unlatch and release latching member 301 from engagement with block 300. Seat support bracket 272 can then be pivoted about seat-angle-adjustment axis 273 (FIG. 92) to the desired seat angle. Leaf spring 314 (FIG. 70) biases seat support bracket 272 upwardly, but spring 314 is made relatively low in force since it need not support the weight of a person since the person has a center of gravity (C of G) located over axis 273. Latching member 301 is then released, such that latching spring 327 biases latching member 301 back into engagement with block 300. The upward bias of leaf spring 314 also prevents an undesired rattle within seat-angle-adjustment mechanism 299 and further provides an acceptable feel during adjustment to persons using chair 20.

Figure 94:
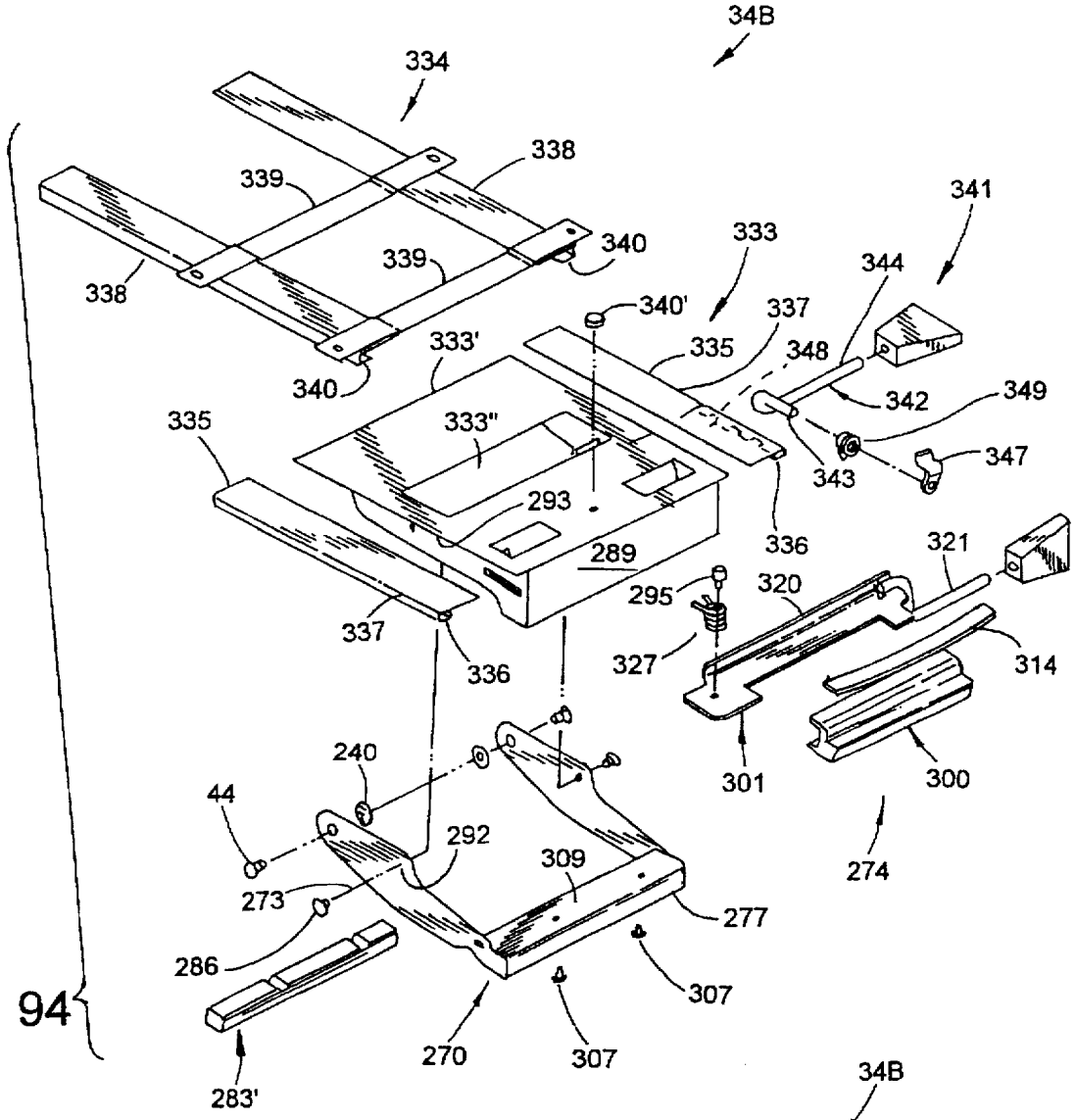
FIG. 94 is an exploded perspective view of the seat-depth-adjustable seat support module shown in FIG. 93.
Figure 93:
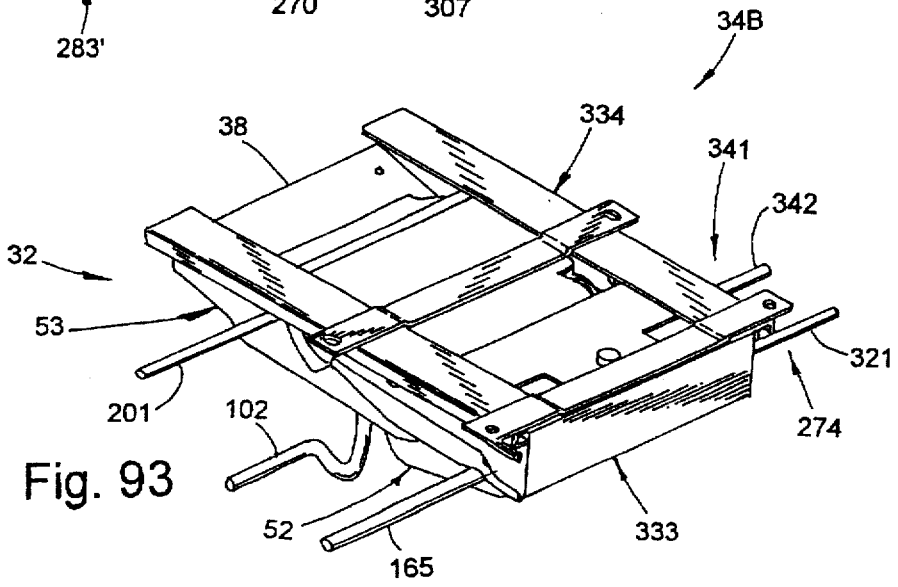
FIG. 93 is a perspective view of a control module shown in FIG. 2 incorporating a seat-depth-adjustable seat support attached to an energy module.

The illustrated seat-depth-adjustable seat support 34B (FIG. 94) includes a synchrotilt bracket 270 having a modified, beefed-up front flange-engaging synchrotilt bushing 283, a seat support bracket 333, a seat angle-adjustment mechanism 274 and a seat-engaging depth-adjustable mechanism including telescoping bracket 334 that slidably engages seat support bracket 333. Thus, a seat support 34B is both angularly adjustable and depth adjustable. However, it is noted that the noted parts can be readily adapted to provide a seat support that is adjustable only in a depth direction (and not angularly) by removing part or all of mechanism 274.

Specifically, seat support bracket 333 (FIG. 94) is generally similar to seat support bracket 272, but seat support bracket 333 is modified to include J-shaped rails 335 attached along the opposing sides of a seat support bracket 333. J-shaped rails 335 include a downwardly extending curled flange 336 defining a track 337. Seat-engaging bracket 334 includes a pair of parallel side members 338 interconnected by a pair of parallel transverse braces 339 to provide a rigid arrangement. Parallel side members 338 each include a C-shaped edge 340 defining a guide for mateably engaging track 337. Thus, seat-engaging bracket 334 telescopingly, slidingly engages track 337 for movement forwardly or rearwardly, thus adjusting the depth of the seat (26) relative to the back (24) (FIG. 1). A stop 340' (FIG. 94) extends upwardly from the top plate 333' of seat support bracket 333 and engages transverse members 339 to limit the fore/aft movement of seat-engaging bracket 334. Top plate 333' includes an aperture 333".

Figure 95:
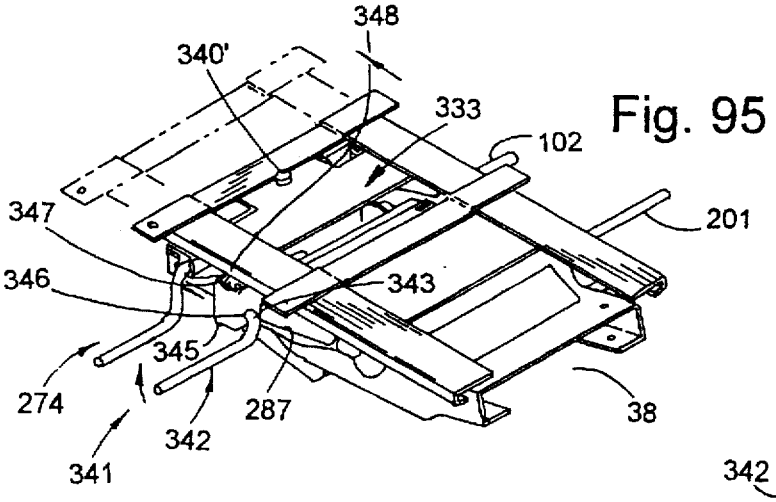
FIG. 95 is a rear perspective view of the control module shown in FIG. 93, the seat-depth-adjustable seat support bracket being shown in a rearwardly adjusted position in solid lines and in a forwardly adjusted position in phantom lines.
Figure 96:
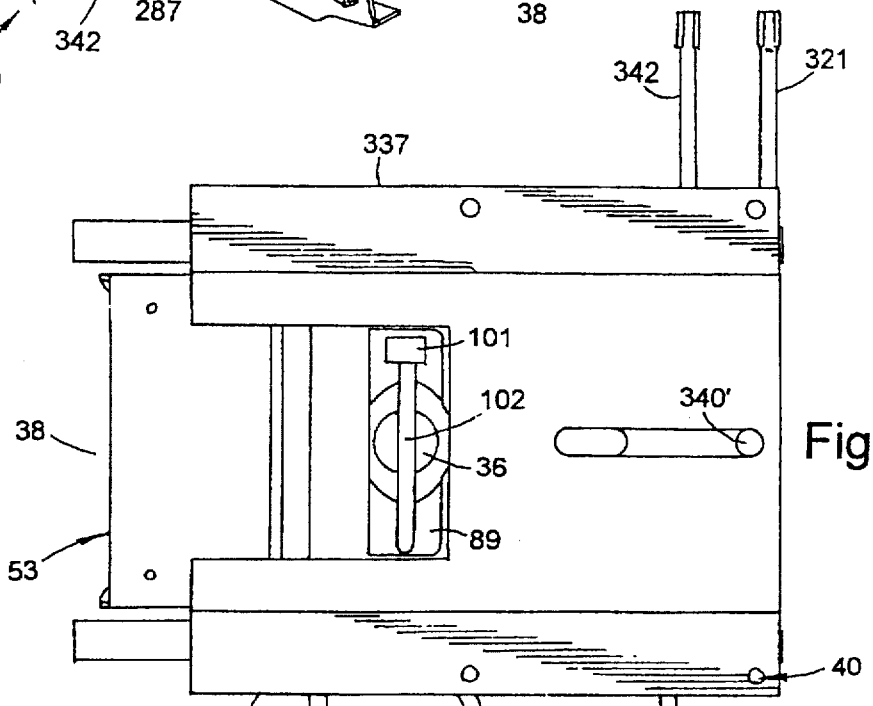
FIG. 96 is a plan view of a modified control module similar to the control module shown in FIG. 93 but including a modified seat-depth-adjustable seat-engaging bracket.
Figure 97:
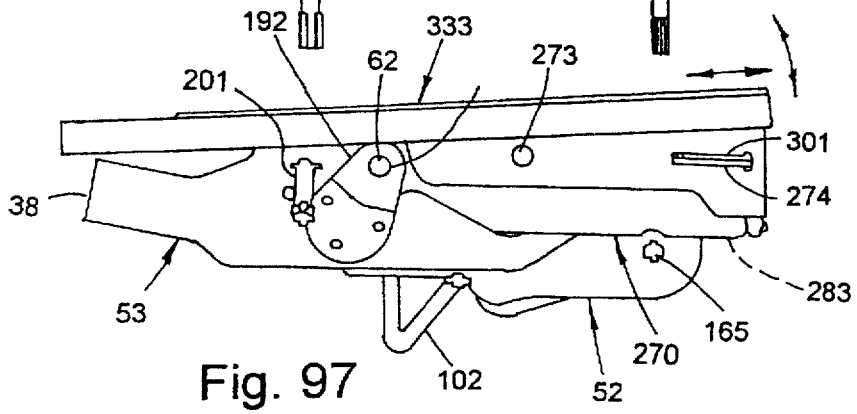
FIG. 97 is a side elevational view of the modified control module shown in FIG. 96.

A depth latch mechanism 341 (FIG. 94) for locking seat-engaging bracket 334 in a selected depth location includes a rod 342 bent into a pivot-forming section 343 and a handle-receiving section 344. A U-shaped bracket 345 (FIG. 95) is attached to sidewall 287 of seat support bracket 333. U-shaped bracket 345 includes a pair of horizontally aligned holes 346, and the pivot-forming section 343 of rod 342 is extended through holes 346. A tooth 347 (FIG. 94) is secured to the end of rod 342. A series of notches 348 are formed in the flange 336 on the side of track 337, and tooth 347 is oriented to releasably engage a selected notch 348 as tooth 347 is pivoted to a raised engaged position by rod 342. Alternatively, tooth 347 can be moved to a released position by pulling upwardly on rod 342, thus rotating tooth 347 downwardly out of engagement with the series of notches 348. A spring 349 (FIG. 94) is also placed on rod pivot-forming section 343 adjacent tooth 347. Spring 349 includes opposing spring ends that engage the sidewall 287 and the tooth 347 to bias tooth toward engagement with a selected one of notches 348.

A variety of back assembly configurations are contemplated. Back assembly 24 (FIG. 98) includes a U-shaped upright 350 and a cushion subassembly 352 secured to back upright 350. Specifically, U-shaped upright 350 comprises a continuous tube bent to form a transverse section 353 and a pair of spaced apart upwardly extending sections 354 and 355. Cushion subassembly 352 is secured to the pair of upwardly extending sections 354 and 355. A box 357 is formed by bending a C-shaped sheet metal bracket around transverse section 353 such that opposing legs 358 and 359 of the bracket abuttingly engage. Legs 358 and 359 are welded together along lines of contact 360 and 361. The center sections 362 and 363 are depressed inwardly into contact, and are spot welded together in locations 364. The opposing legs 358 and 359 define a cross section having a rectangular pattern of corners 365, which pattern defines connector 39 for mateably engaging female connector 38 on back upright support bracket 53 of energy module 32. Attachment holes 370 are provided in a pattern corresponding to the attachment holes 371 in back upright support bracket 53 for receiving screws to securely hold the assembly together.

Figure 99:
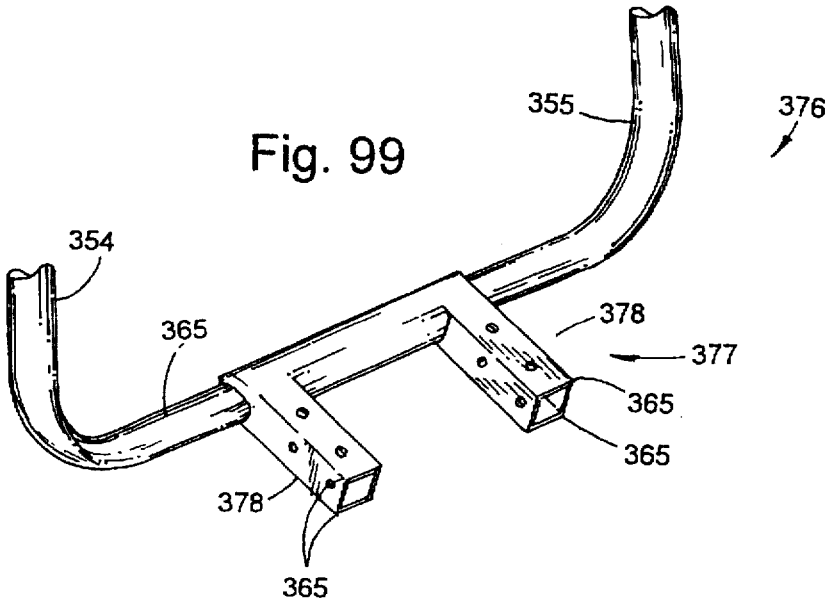
FIGS. 99–103 are perspective views showing lower sections of alternative back uprights for engaging the rear connector on the back upright support bracket of the energy module.

A number of different back upright connector configurations are contemplated. For example, a back upright 376 (FIG. 99) includes a U-shaped tubular member 377 attached to transverse section 252 of U-shaped back tube 353/354/355. Legs 378 of U-shaped member 377 are spaced apart square tube sections forming the rectangular pattern of square corners 365 forming connector 39.

Figure 100:
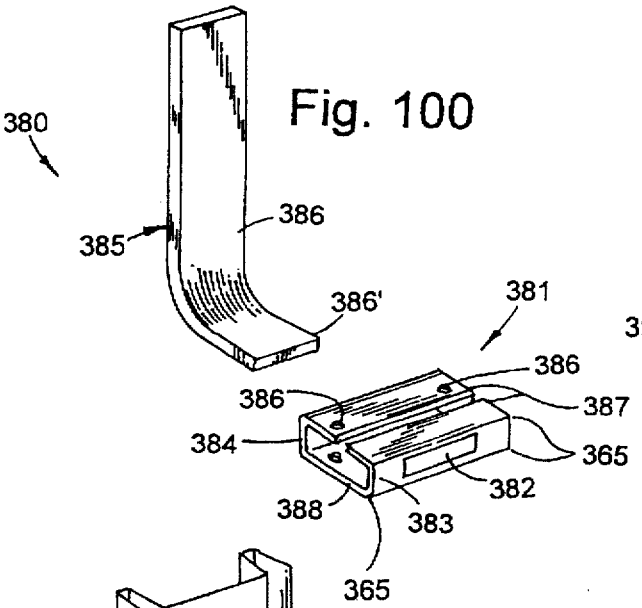

Another back upright 380 (FIG. 100) includes a box-shaped connector/structure 381 comparable in shape at its rectangular corners 365 to box 357. A slot 382 is formed in the front and rear walls 383 and 384 of box 381. A back upright 385 includes a blade 386 with a forwardly extending section 286' configured to slidably engage slot 382. Holes 386 are provided in the top and bottom walls 387 and 388 for receiving bolts (not shown) to clampingly hold blade 386 in a desired position.

Another back upright 389 includes connector structure 390 (FIG. 101) having a pair of parallel J-shaped tubes 391 and 392 having respective end sections 393 and 394 formed into square cross sections. The square tube end sections 393 and 394 are interconnected by a brace 395. The corners of the end sections 393 and 394 define a rectangular pattern of corners 365 shaped to form male connector 39 for engaging female connector 38 on back upright support bracket 53.

Figure 102:
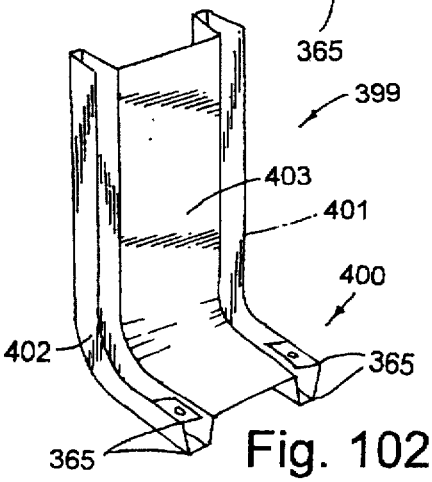

Another back upright 399 includes connector structure 400 (FIG. 102) having a sheet metal bracket having U-shaped reinforcement flanges 401 and 402 formed along each side of a J-shaped center panel 403. The J-shaped section forms a stiff member due to the deformation of the sheet material along the reinforcement flanges 401 and 402 during the forming process. The rectangular corners 365 of the flanges 401 and 402 form the male connector 39, such that structure 400 defines a rectangular pattern of corners 365 configured to mateably engage female connector 38 on back upright support bracket 52 (FIG. 2).

Figure 103:
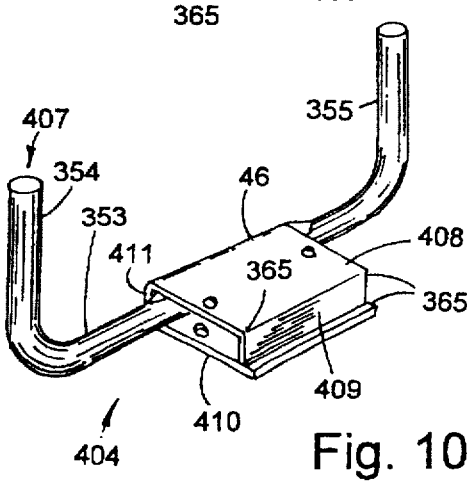

Still another back upright 404 includes connector structure 405 (FIG. 103) having a box 406 formed around a U-shaped tube 407 including tubular sections 353/354/355. The box 406 includes orthogonally related walls 408, 409, 410 and 411, upper and lower walls 408 and 410 being spaced apart without reinforcement. This allows upper and lower walls 408 and 410 to flex, thus providing some resilient movement of a back cushion assembly attached to structure 405, although it is noted that the resilient movement will be a function of the extend that box 406 extends from connector 38 when assembled to a chair control and also a function of the rigidity of attachment between upper and lower walls 408 and 410 to connector 38. Box 406 includes corners 365 defining connector 39.

Figure 10:
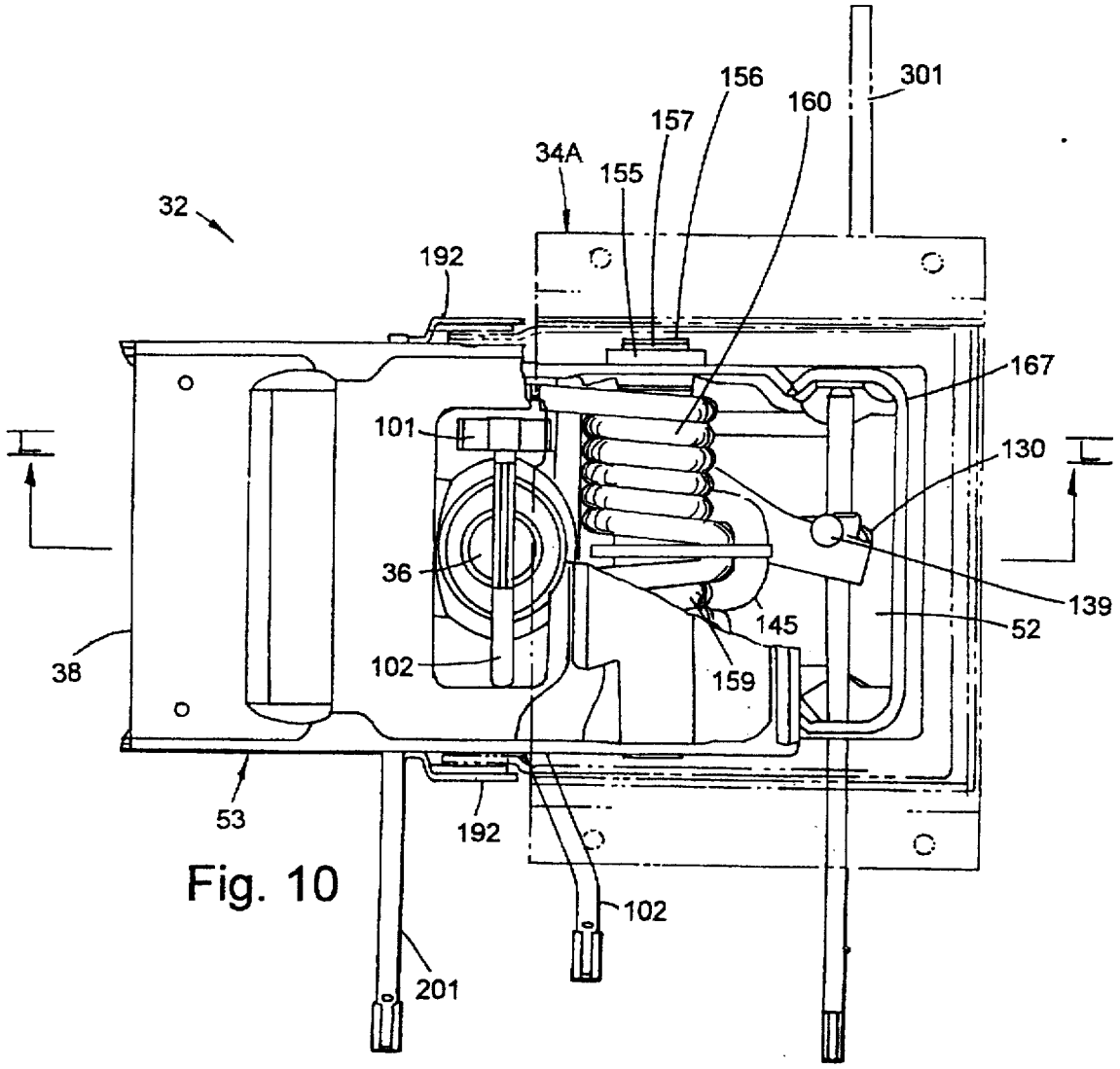
FIG. 10 is a plan view, partially broken away, of the energy module shown in FIG. 8, including a seat support module shown in phantom attached to the top of the energy module.
Figure 11:
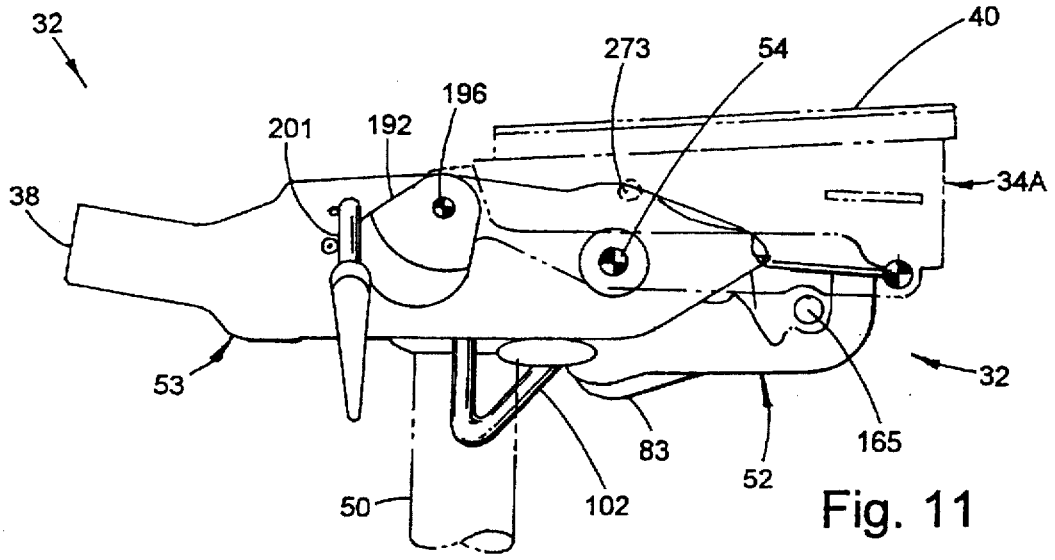
FIG. 11 is a side view of the energy module and seat support shown in FIG. 10.
Figure 12:
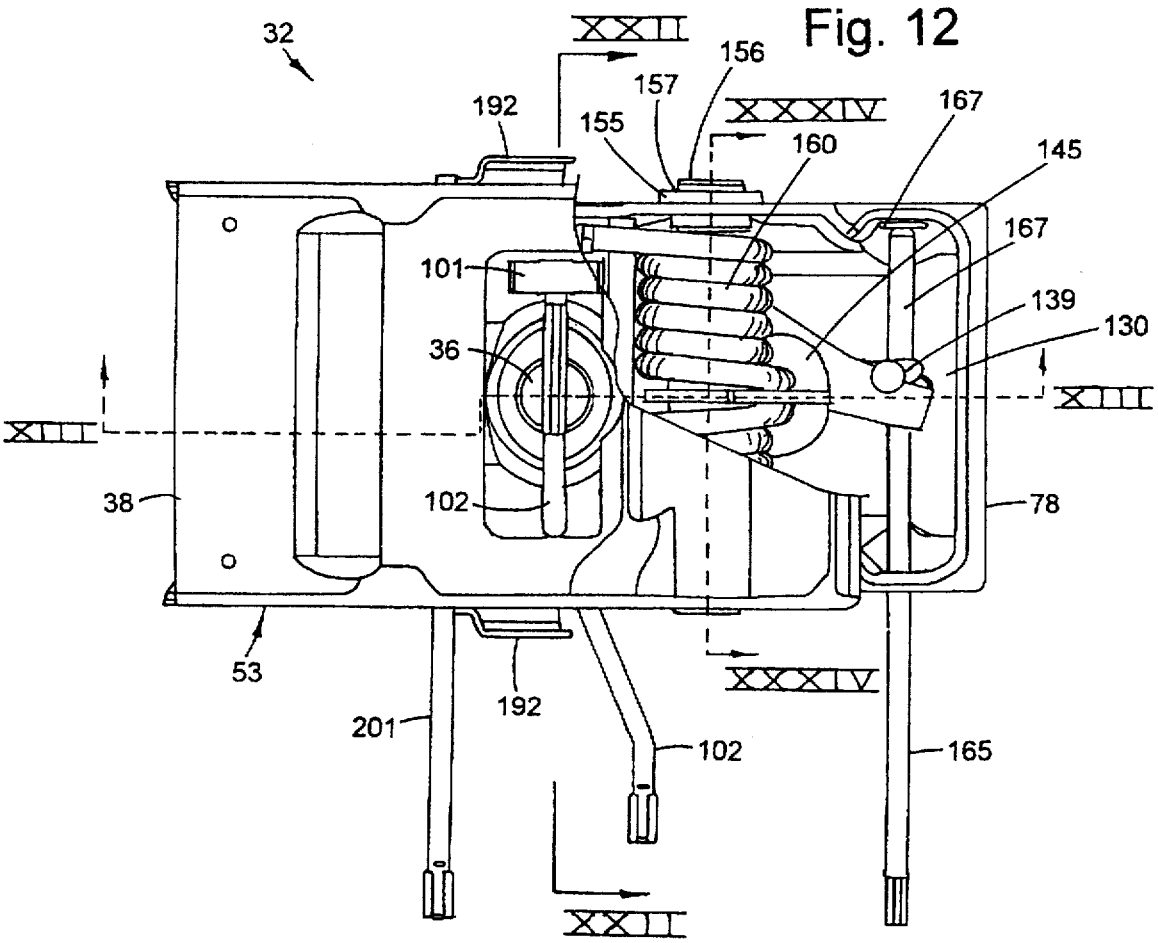
FIG. 12 is a plan view, partially broken away, of the energy module shown in FIG. 8.
Figure 13:
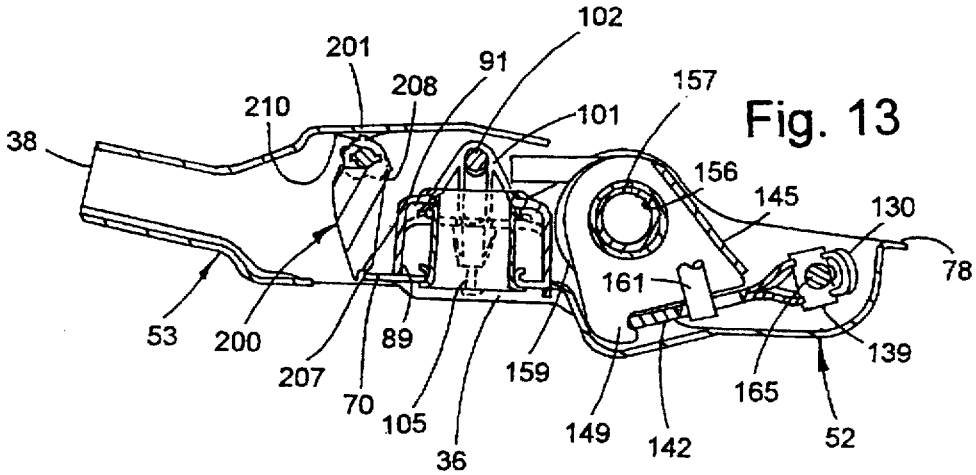
FIG. 13 is a cross-sectional view taken along the plane XIII—XIII in FIG. 12.
Figure 101:
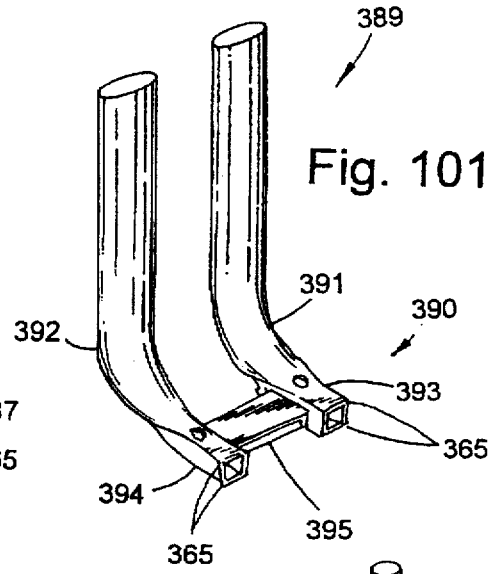

A number of different back and seat subassemblies incorporating one or more of the aforementioned back uprights are contemplated. Back assembly 24 and seat assembly 26 (FIG. 3) are separate units, with back assembly 24 including the upright 350 defining a connector 39 adapted for connection to connector 38 on back upright support bracket 53, and with seat assembly 26 including a structural seat pan 414 defining a connection 41 for connection to connection 40 on seat support 34. Cushions and fabric are applied to back assembly 24 and seat assembly 26 in conventional ways not necessary to an understanding of the present invention. Contrastingly, back 24A and seat 26A of back and seat assembly 27 are substantially independent units, but are interconnected by a web of material 420 providing a degree of interconnection. Also, back and seat assembly 27 (FIG. 10) includes an upright structure 421 similar to upright structure 389. Back and seat assembly 27A (FIG. 3) incorporates a resilient structural shell 425 adapted to resiliently support back 24B on seat 26B. Such a shell is disclosed in commonly assigned U.S. Pat. No. 5,385,388, issued Jan. 31, 1995, to Faiks et al., which disclosure is incorporated herein by reference. Assembly 24B/26B further includes a manually adjustable lumbar support 426 operably mounted in back 24B for vertical adjustment. The lumbar support 426 includes a translatable lumbar pillow 427, a transverse rotatable rod 428, and a frictional engagement construction such as a rack and pinion gear arrangement 429 for vertically moving the lumbar pillow 427 as wheel 429 on rod 428 is rotated in a selected direction. The upright 430 for supporting the back is not unlike upright structure 389 (FIG. 101). Still another back and seat assembly 27B (FIG. 3) includes an upright structure for supporting back 24C similar to upright structure 389. A pair of leaf springs 437 are attached to the top sections 438 of upright structure 436 for supporting back 439 on upright structure 436 to provide additional comfort and resilient support of the back 24C. Seat 26C attaches to the seat support bracket of the selected chair control, as previously described.

The arms 28, 28A and 28B (FIG. 4) include various shapes each having a lower section 445 configured for attachment to the bottom of the seat subassembly or the fixed housing 52. In particular, the arms include a T-shaped vertically adjustable arm 28, a multi-position arm 28A including a rotatable pad 440 and a vertically telescopingly extendable post 441, and a configured loop arm 28B. The arm 28 is disclosed in U.S. Pat. No. 5,385,388, previously incorporated herein by reference. The arm 28A is disclosed in the application entitled "ARTICULATED ARMREST", filed on even date herewith, which has also been incorporated by reference.

The base assemblies 31, 31A and 31B include the following pedestal types: a pneumatic gas spring height adjustable pedestal 50 attached to a five-leg caster-supported base 451, a mechanically activated screw-type height adjustable pedestal 453 attached to a five-leg caster-supported base 454, and a fixed height pedestal 455 attached to a non-rollable base 456, respectively.

Figure 104:
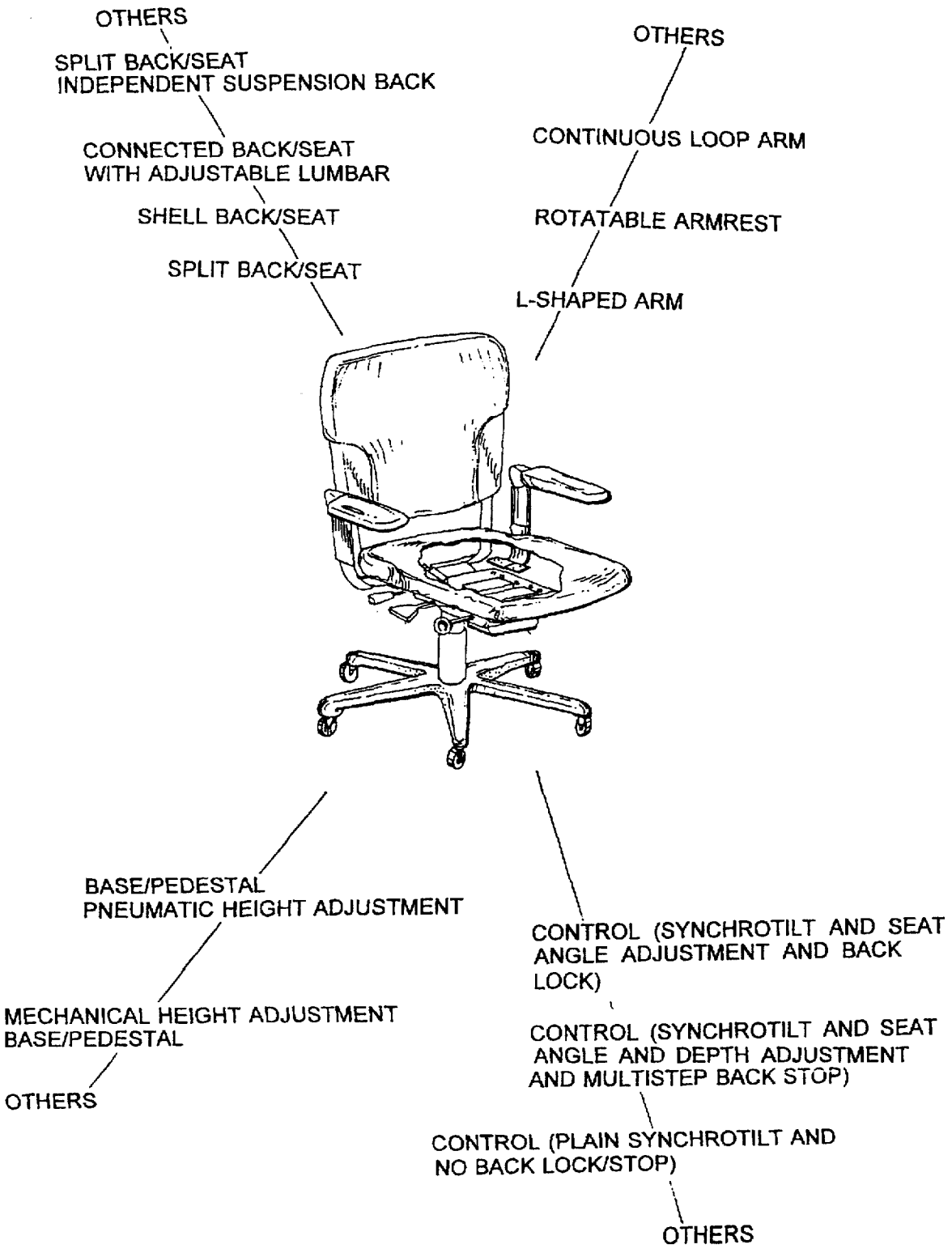
FIG. 104 is a schematic view showing the modular chair construction with optional features being indicated by word descriptions located along radiating lines.

A myriad of chairs having selected features can be manufactured with common parts as illustrated in FIG. 104. Various back and seat assemblies can be readily combined with various selected arms, and various selected base assemblies. Importantly, the chair control can be selectively assembled from selected energy modules and from selected seat support modules to provide a chair having more than just aesthetic differences in appearance, but also wide differences in adjustability and in functional performance. Still further, chairs can be adapted and/or upgraded even after assembly to meet various needs. Advantageously, the modular assembly still allows a manufacturer to take advantage of mass production while minimizing investment in inventory through use of common parts, and further allows constant redesign and improvement substantially without disruption of the manufacturing process.

Figure 105:
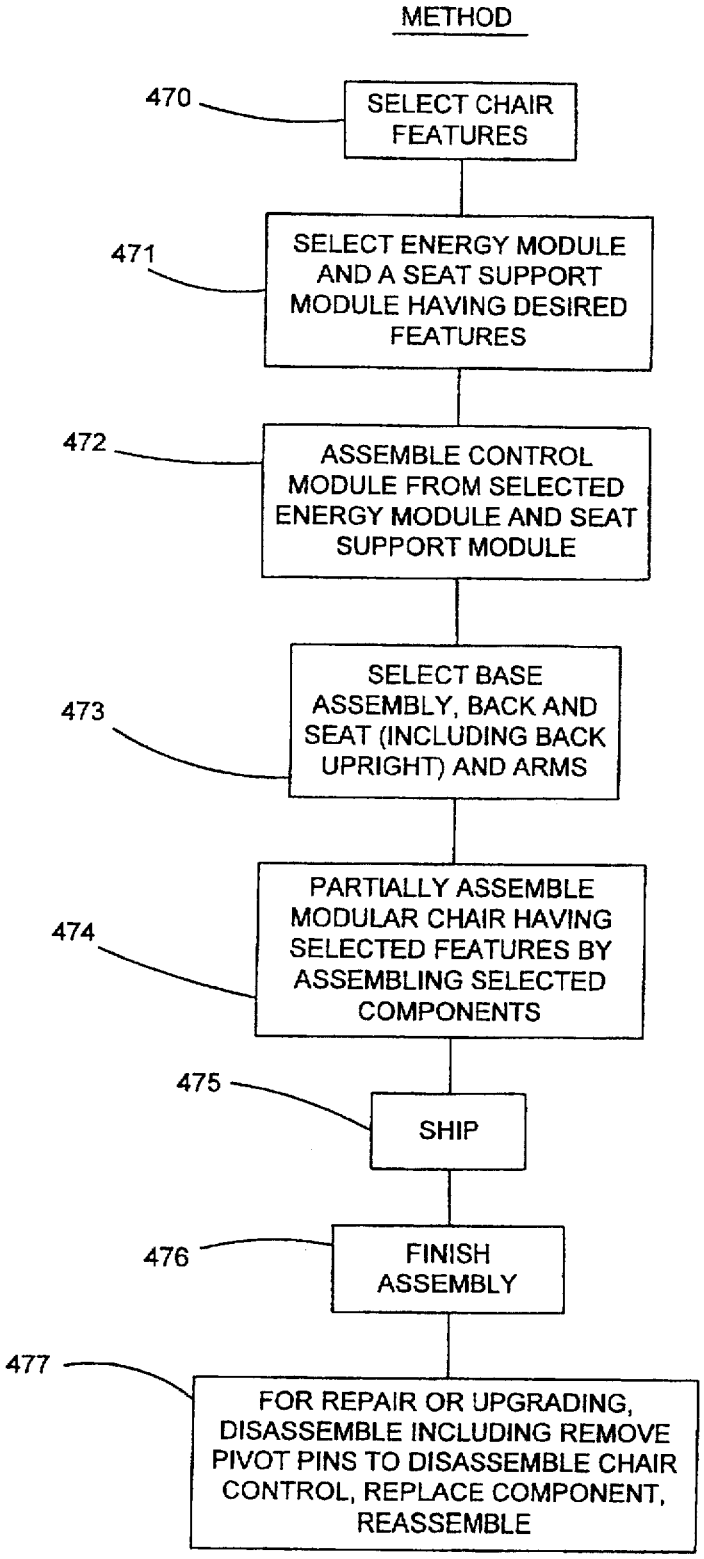
FIG. 105 is a flow chart showing a method of assembly.

A method of manufacture (FIG. 105) includes providing a menu of chair control modules, including energy modules and seat support modules, and a menu of mating base assemblies, back and seat assemblies, and arms assemblies. Once a customer selects the features desired (in step 470), the appropriate energy module and seat support module are selected to provide the desired features and performance characteristics (step 471). These components are assembled into a chair control (step 472). The selected base assembly, arm assembly, and seat and back assemblies are then selected (step 473) and assembled (step 474) to the extent desired to facilitate quality control and also compact shipment of components. The components are then shipped (step 475) and finish assembled on-site (step 476). Notably, repair and/or upgrading (step 477) can be made as desired by temporarily removing pivot pins (44), and by replacing the particular module as desired.

Having described the invention, it should be understood that although a preferred embodiment has been disclosed herein, other modifications and embodiments can be utilized without departing from the spirit of this invention. Therefore, this invention should not be limited to only the embodiment illustrated.

The embodiments of the invention in which an exclusive property or privilege is claimed are defined as follows:

1. A synchrotilt chair control comprising:

a fixed housing;

a back upright support bracket rotationally connected to said fixed housing, said back upright support bracket including first pivot receiving structure;

a seat support configured to be removably attached to said back upright support bracket, said seat support including a second pivot receiving structure alignable with said first pivot receiving structure; and removable/interference-fit pivot pins pivotally engaging said first and second pivot receiving structure for pivotally securing said seat support to said back upright support bracket, said pivot pins being removable from said synchrotilt chair control so that said seat support can be readily removed and replaced; said first pivot-receiving structure including spaced apart inner and outer flange pairs defining a space for receiving said second pivot-receiving structure, each of said inner and outer flange pairs defining a clevis-simulating arrangement for supporting one of said pivot pins on opposing sides of said second pivot-receiving structure.

2. A synchrotilt chair control as defined in claim 1 wherein said first pivot-receiving structure includes pivot-forming holes located on opposing sides of said back upright support bracket, said pivot-forming holes defining a common axis of rotation for said back upright support bracket and said seat support, said common axis extending through said back upright support bracket, said pivot pins being removable from an exterior of said back upright support bracket.

3. A synchrotilt chair control as defined in claim 2 wherein said seat support includes a synchrotilt bracket connected to said back upright support bracket and a seat adjustment mechanism operably connected to said synchrotilt bracket.

4. A synchrotilt chair control as defined in claim 1 wherein said seat support includes a seat adjustment mechanism.

5. A synchrotilt chair control as defined in claim 4 wherein said seat adjustment mechanism includes a seat-angle-adjustment mechanism.

6. A synchrotilt chair control as defined in claim 4 wherein said seat adjustment mechanism includes a seat-depth-adjustment mechanism.

7. A synchrotilt control for chairs comprising:

a fixed housing having a front flange;

a back upright support bracket pivotally mounted to said fixed housing for pivotal movement about a back tilt axis spaced from said front flange, said back upright support bracket being movable between a fully upright position and a fully reclined position, said back upright support bracket including first apertured flanges spaced from said front flange and from said back tilt axis;

a synchrotilt bracket including a front-flange-engaging bearing for mateably receiving and capturing said front flange to define a low friction non-stationary seat tilt axis and further including second apertured flanges alignable with said first apertured flanges and defining a common axis; and interference-fit pivot pins removably engaging said first and second apertured flanges for pivotally securing said synchrotilt bracket to said back upright support bracket, said pivot pins including a circumferential recess providing the interference-fit.

8. A synchrotilt control as defined in claim 7 wherein said synchrotilt bracket is U-shaped.

9. A synchrotilt control as defined in claim 8 wherein said first apertured flanges define pivot-forming holes located on opposing sides of said back upright support bracket, said pivot-forming holes defining said common axis such that said common axis extends through said back upright support bracket.

10. A synchrotilt control as defined in claim 9 wherein said common axis moves over-center with respect to a line connecting said back tilt axis and said seat tilt axis when said back upright support bracket is pivoted between said fully upright position and said fully reclined position.

11. A synchrotilt chair control comprising:

an energy module including a fixed housing, a back upright support bracket rotatably connected to said fixed housing, and an energy source, said back upright support bracket being movable between a fully upright position and a fully reclined position with said energy source biasing said back upright support bracket toward said fully upright position;

a synchrotilt bracket having one end rotatably secured to said fixed housing and a second end pivotally secured to said back upright support bracket; and an angularly adjustable seat support connected to said synchrotilt bracket for rotation therewith during recline of the back upright support bracket, the angularly adjustable seat support further being constructed to be separately angularly adjustable on the synchrotilt bracket while the back upright support bracket is in a stationary position, said angularly adjustable seat support defining a seat-angle-adjustment axis located generally under the center of gravity of a person sitting on a seat attached to said adjustable seat support so that the relative position of the seat to said fixed housing can be adjusted while the person is sitting on the seat without the weight of the person adversely affecting the effort required to make the adjustment.

12. A synchrotilt chair control as defined in claim 11 wherein said synchrotilt bracket is U-shaped.

13. A synchrotilt chair control as defined in claim 11 including removable pivot pins connecting said synchrotilt bracket to said back upright support bracket.

14. A synchrotilt chair control comprising:

an energy module including a fixed housing, a back upright support bracket rotatably connected to said fixed housing, and an energy source, said back upright support bracket being movable between a fully upright position and a fully reclined position with said energy source biasing said back upright support bracket toward said fully upright position;

a synchrotilt bracket having one end rotatably secured to said fixed housing and a second end pivotally secured to said back upright support bracket; and a seat-depth-adjustable seat support connected to said synchrotilt bracket for rotation therewith during recline of the back upright support bracket, said seat-depth-adjustable seat support including a slidably adjustable seat-engaging support bracket and a releasable latch mechanism for providing independent fore/aft adjustment of a seat attached to said seat-engaging support bracket relative to said synchrotilt bracket, the seat-depth-adjustable seat support being constructed for ready adjustment while a person is seated on the seat.

15. A synchrotilt chair control as defined in claim 14 including removable pivot pins connecting said synchrotilt bracket to said back upright support bracket.

16. A synchrotilt chair control as defined in claim 15 wherein said synchrotilt bracket is U-shaped.

17. A synchrotilt chair control comprising:

a fixed housing;

a back upright support bracket rotationally connected to said fixed housing, said back upright support bracket including first pivot receiving structure;

a seat support configured to be removably attached to said back upright support bracket, said seat support including a second pivot receiving structure alignable with said first pivot receiving structure; and removable/interference-fit pivot pins pivotally engaging said first and second pivot receiving structure for pivotally securing said seat support to said back upright support bracket, said pivot pins being removable from said synchrotilt chair control so that said seat support can be readily removed and replaced.

18. A synchrotilt control for chairs comprising:

a fixed housing having a front flange;

a back upright support bracket pivotally mounted to said fixed housing for pivotal movement about a back tilt axis spaced from said front flange, said back upright support bracket being movable between a fully upright position and a fully reclined position, said back upright support bracket including first apertured flanges spaced from said front flange and from said back tilt axis;

a synchrotilt bracket including a front-flange-engaging bearing for mateably receiving and capturing said front flange to define a low friction non-stationary seat tilt axis and further including second apertured flanges alignable with said first apertured flanges and defining a common axis; and interference-fit pivot pins removably engaging said first and second apertured flanges for pivotally securing said synchrotilt bracket to said back upright support bracket.

19. A synchrotilt control as defined in claim 18 wherein said pivot pins include an irregular surface providing the interference fit.

* * * * *